US005560126A

United States Patent [19]

Meschan et al.

[11] Patent Number: 5,560,126

[45] Date of Patent: Oct. 1, 1996

[54] ATHLETIC SHOE WITH IMPROVED SOLE

[75] Inventors: David F. Meschan, Greensboro, N.C.; Tuan N. Le, Portland, Oreg.

[73] Assignee: Akeva, L.L.C., Greensboro, N.C.

[21] Appl. No.: 291,945

[22] Filed: Aug. 17, 1994

Related U.S. Application Data

[63] Continuation-in-part of Ser. No. 108,065, Aug. 17, 1993.

[51] Int. Cl.[6] ..... A43B 21/36; A43B 21/32; A43B 21/24

[52] U.S. Cl. ..... 36/42; 36/39; 36/36 R; 36/36 A; 36/27; 36/31; 36/35 R; 36/15; 36/37

[58] Field of Search ..... 36/42, 39, 69, 36/41, 366, 36 A, 36 C, 34 R, 27, 31, 35 R, 25 R, 15, 100, 101, 103, 105, 37, 38

[56] References Cited

U.S. PATENT DOCUMENTS

| | | | |
|---|---|---|---|
| Re. 33,648 | 7/1991 | Brown . | |
| 48,682 | 7/1865 | Hayward et al. . | |
| 221,592 | 11/1879 | Mitchell et al. . | |
| 537,492 | 4/1895 | Smith | 36/69 |
| 652,887 | 7/1900 | Butterfield . | |
| 789,089 | 5/1905 | Frank . | |
| 818,861 | 4/1906 | Beck et al. . | |
| 1,046,815 | 12/1912 | Lavoie | 36/39 |
| 1,062,338 | 5/1913 | Kane . | |
| 1,112,635 | 10/1914 | May | 36/36 R |
| 1,316,505 | 9/1919 | O'Neill | 36/42 |
| 1,318,247 | 10/1919 | Victor . | |
| 1,346,841 | 7/1920 | Padden . | |
| 1,366,601 | 1/1921 | Sellars | 36/42 |
| 1,371,339 | 3/1921 | Arntz et al. | 36/42 |
| 1,410,064 | 3/1922 | Hunt . | |
| 1,439,757 | 12/1922 | Redman . | |
| 1,439,758 | 12/1922 | Redman . | |
| 1,444,677 | 2/1923 | Fischer | 36/39 |
| 1,458,257 | 6/1923 | Van Melle . | |
| 1,479,773 | 1/1924 | Craig . | |
| 1,516,384 | 11/1924 | Kamada . | |
| 1,542,174 | 6/1925 | Robidoux . | |
| 1,611,024 | 12/1926 | Grimaldi . | |
| 2,002,087 | 5/1935 | Esterson . | |
| 2,208,260 | 7/1940 | Hayden . | |
| 2,288,168 | 6/1942 | Leu . | |
| 2,300,635 | 11/1942 | Shepherd . | |
| 2,374,954 | 5/1945 | Pipitone . | |

(List continued on next page.)

FOREIGN PATENT DOCUMENTS

| | | | |
|---|---|---|---|
| 533972 | 3/1922 | France | 36/36 R |
| 648339 | 7/1937 | Germany | 36/36 R |
| 693394 | 7/1940 | Germany . | |
| 947054 | 7/1956 | Germany | 36/39 |
| 2154951 | 5/1973 | Germany . | |
| 2742138 | 3/1979 | Germany . | |
| 434029 | 10/1967 | Switzerland . | |
| 25728 | 11/1909 | United Kingdom | 36/39 |
| 83342 | 2/1911 | United Kingdom . | |
| 229884 | 3/1924 | United Kingdom . | |
| 1540926 | 2/1979 | United Kingdom . | |
| 2144024 | 2/1985 | United Kingdom . | |

OTHER PUBLICATIONS

"New Footwear Concepts" by E. I. du Pont de Nemours & Co. (1988).

Etonic Spring 1996 Footwear catalogue.

International Search Report for International Appln. PCT/US94/09001 dated Jan. 2, 1995.

*Primary Examiner*—Marie D. Patterson

*Attorney, Agent, or Firm*—Finnegan, Henderson, Farabow, Garrett & Dunner

[57] ABSTRACT

A shoe includes a heel support for receiving a rotatable and replaceable rear sole to provide longer wear. The shoe may also include a graphite insert supported by the heel support between the heel and the rear sole to reduce midsole compression and provide additional spring. The replaceable rear sole and the graphite insert allow the shoe to be adapted to different desired performance characteristics depending upon the intended activity and terrain or playing surface.

42 Claims, 19 Drawing Sheets

U.S. PATENT DOCUMENTS

| | | | |
|---|---|---|---|
| 2,500,302 | 3/1950 | Vicente . | |
| 2,540,449 | 2/1951 | Kaufman . | |
| 2,556,842 | 6/1951 | Gilmour . | |
| 2,607,134 | 8/1952 | Langer . | |
| 2,628,439 | 2/1953 | Rochlin . | |
| 2,707,341 | 5/1955 | Romano . | |
| 2,745,197 | 5/1956 | Holt . | |
| 2,806,302 | 9/1957 | Sharpe . | |
| 2,998,661 | 9/1961 | Israel | 36/35 R |
| 3,083,478 | 4/1963 | Rakus | 36/36 R |
| 3,085,359 | 4/1963 | Rubens . | |
| 3,087,265 | 4/1963 | McKinley . | |
| 3,171,218 | 3/1965 | D'Urbano | 36/36 R |
| 3,208,163 | 9/1965 | Rubens . | |
| 3,237,321 | 3/1966 | McKinley . | |
| 3,271,885 | 9/1966 | McAuliffe . | |
| 3,318,025 | 5/1967 | Antelo . | |
| 3,455,038 | 7/1969 | Kasdan | 36/39 |
| 3,478,447 | 11/1969 | Gillead . | |
| 3,514,879 | 6/1970 | Frattallone . | |
| 3,566,489 | 3/1969 | Morley . | |
| 3,593,436 | 5/1969 | Vietas . | |
| 3,646,497 | 2/1972 | Gillikin . | |
| 3,664,041 | 5/1972 | Frattallone . | |
| 3,775,874 | 12/1973 | Bonneville . | |
| 3,782,010 | 1/1974 | Frattallone . | |
| 3,928,881 | 12/1975 | Bente . | |
| 3,988,840 | 11/1976 | Minihane . | |
| 4,062,132 | 12/1977 | Klimaszewski . | |
| 4,067,123 | 1/1978 | Minihane . | |
| 4,098,011 | 7/1978 | Bowerman . | |
| 4,214,384 | 7/1980 | Gonzalez . | |
| 4,224,749 | 9/1980 | Diaz-Cano | 36/34 R |
| 4,262,434 | 4/1981 | Michelotti . | |
| 4,263,728 | 4/1981 | Frecentese . | |
| 4,267,650 | 5/1981 | Bauer . | |
| 4,322,894 | 4/1982 | Dykes . | |
| 4,363,177 | 12/1982 | Boros . | |
| 4,372,058 | 2/1983 | Stubblefield . | |
| 4,377,042 | 3/1983 | Bauer . | |
| 4,378,643 | 4/1983 | Johnson . | |
| 4,393,605 | 7/1983 | Spreng . | |
| 4,414,763 | 11/1983 | Bente . | |
| 4,429,474 | 2/1984 | Metro . | |
| 4,449,307 | 5/1984 | Stubblefield . | |
| 4,455,766 | 6/1984 | Rubens . | |
| 4,510,700 | 4/1985 | Brown . | |
| 4,541,185 | 9/1985 | Chou . | |
| 4,546,556 | 10/1985 | Stubblefield . | |
| 4,550,510 | 11/1985 | Stubblefield . | |
| 4,598,487 | 7/1986 | Misevich . | |
| 4,606,139 | 8/1986 | Silver . | |
| 4,608,768 | 9/1986 | Cavanagh . | |
| 4,610,100 | 9/1986 | Rhodes . | |
| 4,622,764 | 11/1986 | Bouler | 36/69 |
| 4,642,917 | 2/1987 | Ungar . | |
| 4,706,392 | 11/1987 | Yang . | |
| 4,741,114 | 5/1988 | Stubblefield . | |
| 4,745,693 | 5/1988 | Brown . | |
| 4,778,717 | 10/1988 | Fitchmun . | |
| 4,785,557 | 11/1988 | Kelley et al. . | |
| 4,811,500 | 3/1989 | Maccano . | |
| 4,875,300 | 10/1989 | Kazz . | |
| 4,879,821 | 11/1989 | Graham et al. . | |
| 4,887,367 | 12/1989 | Mackness et al. . | |
| 4,936,028 | 6/1990 | Posacki . | |
| 4,979,319 | 12/1990 | Hayes . | |
| 4,995,173 | 2/1991 | Spier . | |
| 5,005,300 | 4/1991 | Diaz et al. . | |
| 5,070,629 | 12/1991 | Graham et al. . | |
| 5,083,385 | 1/1992 | Halford . | |
| 5,092,060 | 3/1992 | Frachey et al. . | |
| 5,185,943 | 2/1993 | Tong et al. . | |
| 5,255,451 | 10/1993 | Tong et al. . | |
| 5,319,866 | 6/1994 | Foley et al. . | |
| 5,381,608 | 1/1995 | Claveria . | |
| 5,402,588 | 4/1995 | Graham et al. . | |

ATHLETIC SHOE WITH IMPROVED SOLE

This is a continuation-in-part of U.S. patent application Ser. No. 08/108,065 filed Aug. 17, 1993, pending.

BACKGROUND OF THE INVENTION

1. Field of the Invention

The present invention relates generally to an improved rear sole for footwear and, more particularly, to a rear sole for an athletic shoe with an extended and more versatile life and better performance in terms of cushioning and spring.

2. Discussion of the Related Art

Athletic shoes, such as those designed for running, tennis, basketball, cross-training, hiking, walking, and other forms of exercise, typically include a laminated sole attached to a soft and pliable upper. The laminated sole generally includes a resilient rubber outsole attached to a more resilient midsole usually made of polyurethane, ethylene vinyl acetate (EVA), or a rubber compound. When laminated, the sole is attached to the upper as a one-piece structure, with the rear sole being integral with the forward sole.

One of the principal problems associated with athletic shoes is outsole wear. A user rarely has a choice of running surfaces, and asphalt and other abrasive surfaces take a tremendous toll on the outsole. This problem is exacerbated by the fact that most pronounced outsole wear, on running shoes in particular, occurs principally in two places: the outer periphery of the heel and the ball of the foot, with heel wear being, by far, a more acute problem. In fact, the heel typically wears out much faster than the rest of the athletic shoe, thus requiring replacement of the entire shoe even though the bulk of the shoe is still in satisfactory condition.

Another problem associated with outsole wear is midsole compression. As previously noted, the midsole is generally made of a resilient material to provide cushioning for the user. However, after repeated use, the midsole is compressed due to the large forces exerted on it during use, thereby causing it to lose its cushioning effect. Midsole compression is the worst in the heel area, particularly the outer periphery of the heel and the area directly under the user's heel bone.

Despite technological advancements in recent years in midsole and outsole design and construction, the benefits of such advancements can still be largely negated, particularly in the heel area, by two months of regular use. The problems become costly for the user since athletic shoes are becoming more expensive each year, with some top-of-the-line models priced at over $150.00 a pair. By contrast with dress shoes, whose heels can be replaced at nominal cost over and over again, the heel area (midsole and outsole) of an athletic shoe cannot be. To date, there is nothing in the art to address the combined problems of midsole compression and outsole wear in athletic shoes, and these problems remain especially severe in the heel area of such shoes.

Designs are known that specify the replacement of the entire outsole of a shoe. Examples include those disclosed in U.S. Pat. Nos. 4,745,693, 4,377,042 and 4,267,650. These concepts are impractical for most applications, especially athletic shoes, for several reasons. First, tight adherence between the sole and the shoe is difficult to achieve, particularly around the periphery of the sole. Second, replacement of the entire sole is unnecessary based upon typical wear patterns in athletic shoes. Third, replacing an entire sole is or would be more expensive than replacing simply the worn elements, a factor which is compounded if a replaceable, full-length sole for every men's and women's shoe size is to be produced. Finally, it would appear that the heel section, in particular, has entirely different needs and requirements from the rest of the shoe sole and deteriorates at a much faster rate.

Other designs, which are principally directed to shoes having a relatively hard heel and outsole (e.g., dress shoes), disclose rear soles that are detachable and which can be rotated when a portion of the rear sole becomes worn. For example, U.S. Pat. No. 1,439,758 to Redman discloses a detachable rear sole that is secured to a heel of the shoe with a center screw that penetrates the bottom of the rear sole and which is screwed into the bottom of the heel of the shoe. Such a design cannot be used in athletic shoes because the resilient midsole and the soft, pliable upper are not rigid enough to retain the center screw. In addition, the center screw would detrimentally affect the cushioning properties of the resilient midsole and may possibly be forced into the heel of the user when the midsole is pressed during use.

Shoes with detachable rear soles that incorporate a center screw or other related securing means to attach the rear sole to the shoe also may experience gapping problems. Gapping refers to the gap that may appear, either initially or over time with extended use, between any detachable and non-detachable elements of a shoe. Any gapping will eventually attract debris or cause flapping and is otherwise aesthetically unpleasing. Such a problem would be particularly severe in a shoe that includes a rear sole made of resilient material that is likely to sag or move away from other surfaces with extended use. Similarly, rear soles dependent on center screws are likely to be pried away at the periphery when resilient materials are used. While related art discloses vertical heel support sidewalls, they do not solve either the gapping or the peripheral pry-away problem in the case of a resilient rear sole. For example, debris is still likely to lodge between a heel support vertical sidewall and a vertical rear sole sidewall; and the rear sole may still be pried away at the periphery if caught in a pavement crack or abrasion, if there is only a vertical wall to retain it. The latter problem is compounded by the fact that a vertical heel support sidewall would grip a resilient rear sole about its midsole where resiliency, by design, is the greatest and least able to resist displacement.

Rotating a rear sole will not, of course, counteract or alleviate midsole compression occurring at the heel center. While replacement of the entire rear sole is always an option, it may be that the full benefit of rotation will not have been realized when heel-center compression makes that necessary or desirable. That is to say that there may be good peripheral outsole and midsole remaining.

Although never in combination with a rotating or removable rear sole, there have been attempts to deal with heel-center midsole compression and/or to add spring to the user's gait by introducing various mechanical components into heel construction. One approach has been to insert horizontally in the heel area a thin layer of hard, flexible material that bends under the user's weight and then returns to its original position when the weight of the user is shifted to the other foot. Such attempts have met with only minimal success, however, for several reasons. Such insert may have lacked enough inherent resiliency from the outset. In other cases, it may have deteriorated with use. In all cases, it has rested on a resilient foundation around its periphery, limiting its ability to flex in the center.

Another problem is that athletic shoe purchasers cannot customize the cushioning or spring in the heel of a shoe to their own body weight, personal preference, or need. They are "stuck" with whatever a manufacturer happens to provide in their shoe size.

Finally, there appears to be relatively few, if any, footwear options available to those persons suffering from foot or leg irregularities, foot or leg injuries, and legs of different lengths, among other things, where there is a need for the left and right rear soles to be of a different height and/or different cushioning or spring properties. Presently, such options appear to include only custom-made shoes that are rendered useless if the person's condition improves or deteriorates.

SUMMARY OF THE INVENTION

The present invention is directed to a shoe that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the system particularly pointed out in the written description and claims, as well as the appended drawings.

To achieve these and other advantages and in accordance with the purpose of the invention, as embodied and broadly described herein, the shoe includes an upper, a forward sole attached to the upper, a heel support attached to the upper, and a rear sole detachably secured or rotatably mounted to the heel support and including at least one ground-engaging layer and a midsole attached to the ground-engaging layer, the midsole made of an elastomeric material that is more resilient than the ground-engaging layer.

In another aspect, the shoe includes an upper, a forward sole attached to the upper, a heel support attached to the upper and having at least one wall extending downwardly from the upper, the wall at least partially defining a recess, a rear sole receivable in the recess of the heel support and having at least one ground-engaging surface, and a graphite insert either supported within the recess of the heel support or by the wall of the heel support between the rear sole and a heel portion of the upper.

It is to be understood that both the foregoing general description and the following detailed description are exemplary and explanatory only and are not restrictive of the invention, as claimed.

The accompanying drawings, which are incorporated in and constitute a part of this specification, illustrate one embodiment of the invention and together with the description, serve to explain the principles of the invention.

DESCRIPTION OF THE PREFERRED EMBODIMENTS

Figure 2:
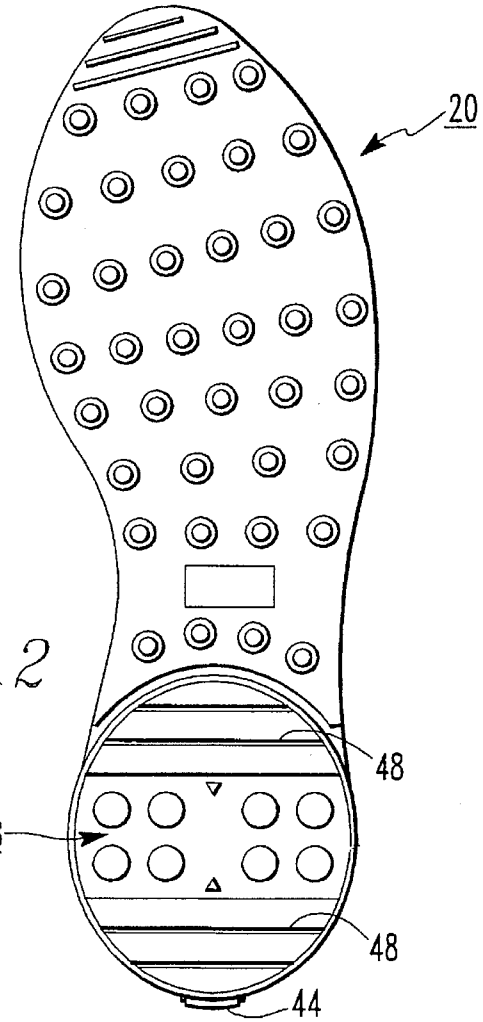
FIG. 2 is a plan view of the shoe of FIG. 1A.

Reference will now be made in detail to the present preferred embodiments of the invention, examples of which are illustrated in the accompanying drawings. Wherever possible, the same reference characters will be used throughout the drawings to refer to the same or like parts.

Figure 1A:
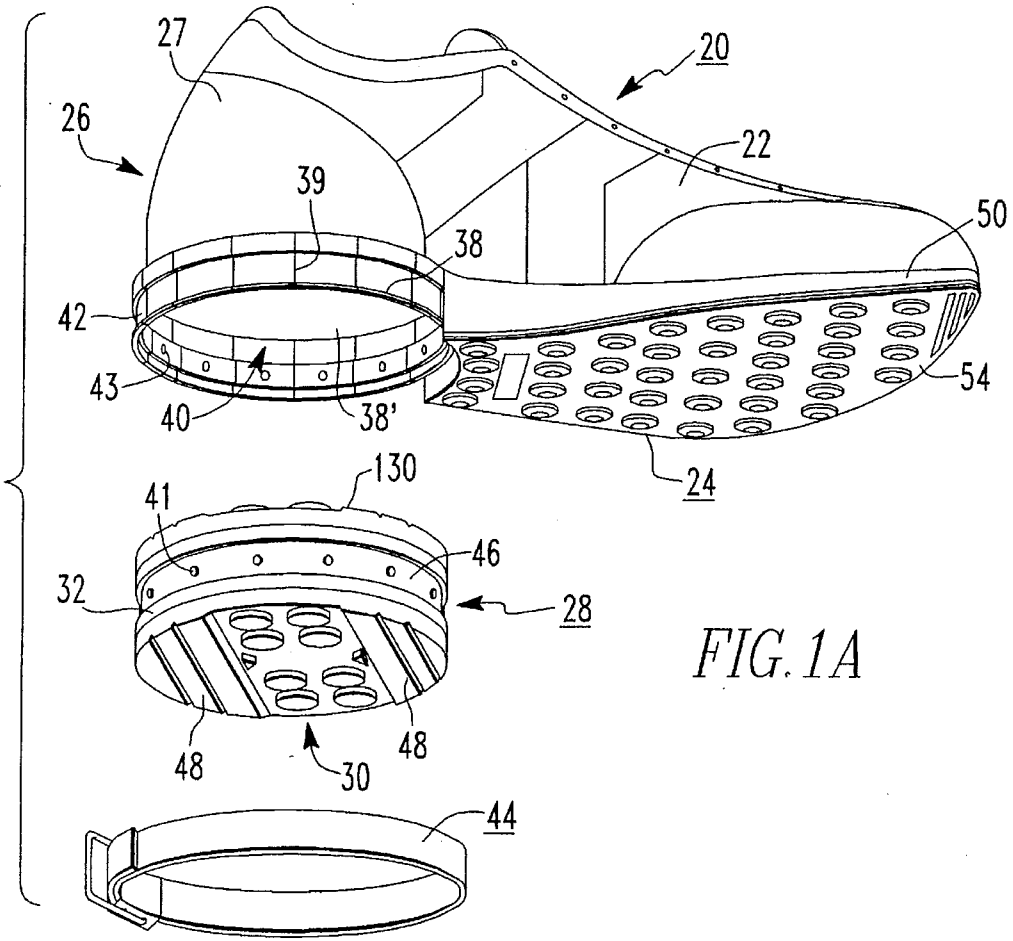
FIGS. 1A and 1B are exploded isometric views of an embodiment of the shoe of the present invention.

FIG. 1A illustrates a first embodiment of the shoe of the present invention. The shoe, designated generally as 20, has a shoe upper 22, a forward sole 24, a heel support 26, and a rear sole 28. The forward sole and heel support are attached to the shoe upper in a conventional manner, typically by injection molding, stitching or gluing.

Figure 3:
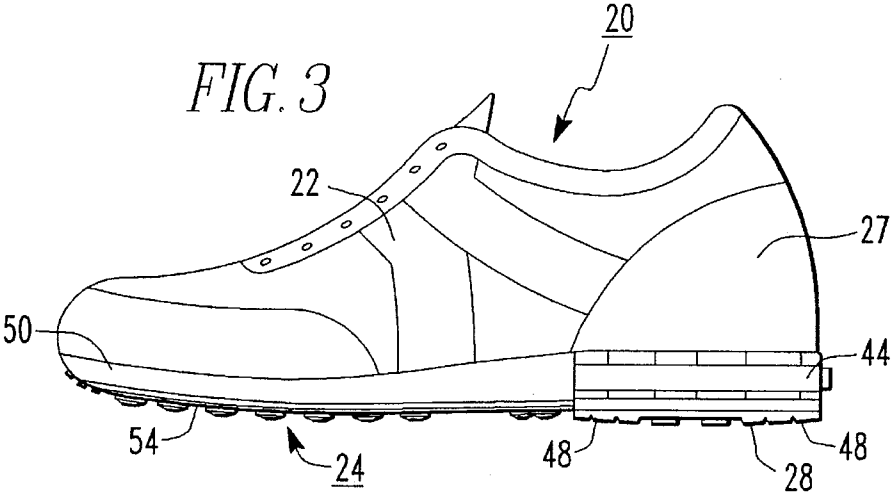
FIG. 3 is a side elevation view of the shoe of FIG. 1A.

As shown in FIG. 3, the forward sole 24 includes a forward midsole 50 and an outsole 54. The forward midsole 50 is attached to the upper, in conventional fashion, e.g., injection molding or gluing, etc., and the outsole 54 is attached to the forward midsole 50, in similar conventional fashion known to those skilled in the art.

As shown in FIG. 1A, the heel support 26 preferably includes a heel counter 27 for stabilizing a heel portion of the upper 22 above the heel support and a side wall 38 that extends downwardly from the upper and defines a recess 40 sized to receive the rear sole. The heel support may also include a substantially horizontal top wall 38' for supporting the heel portion of the upper. Otherwise, the top of the rear sole or an insert, as will be discussed in more detail later, will support the heel portion of the upper. The components of the heel support, including heel counter 27 and the side wall 38, are preferably made integral through injection molding or other conventional techniques and are preferably composed of plastic, such as a durable plastic manufactured under the name PEBAX.

The rear sole 28 is preferably made from two different materials: a rubber compound for a first ground-engaging surface 30; and a softer, elastomeric material such as polyurethane or ethylene vinyl acetate (EVA) for the midsole 32 of the heel. Optionally, a notched section 46 of the midsole 32 can be made of a hard plastic material. However, the rear sole could be comprised of a single homogenous material, or two materials (e.g., EVA enveloped by hard rubber), or any number of layers or combinations of materials, including a material comprising the air encapsulating tubes, for example, disclosed in U.S. Pat. No. 5,005,300.

The rear sole 28 is detachable from the heel support 26. This allows the user the ability to change rear soles entirely when either the sole is worn to a significant degree, or the user desires a different sole for desired performance characteristics for specific athletic endeavors or playing surfaces.

The rear sole 28 can also be rotatably mounted on the heel support 26. The rear sole can be rotated to a plurality of positions (although only four positions are possible in the FIG. 1A embodiment), with a means provided to allow the user to secure the rear sole at each desired position. After a period of use, the periphery of the ground-engaging surface 30 will exhibit a wear pattern at the point in which the heel first contacts the ground, when the user is running, for example. Excessive wear occurs at this point, and at the midsole, degrading the performance of the rear sole. When the user determines that the wear is significant enough, the user detaches the rear sole 28 from the heel support 26, and rotates the rear sole so that the worn portion will no longer be in the location of the user's first heel strike. Rotation can occur in an axis aligned with the major axis of the shoe, so that the heel is in effect "flipped" or inverted. Rotation can also occur about an axis normal to the major axis of the shoe, or any combination of the above. The user then re-engages and secures the rear sole to its new position so that the rear sole will not become dislodged during use. The number of positions into which the rear sole can be rotated is not limited; however, the embodiment depicted in FIG. 1A permits on both axes a total of only four such positions due to the elliptical shape of the rear sole.

Rotating the rear sole about an axis normal to the shoe's major axis to a position of, for example, of 180 degrees beyond its starting point, will locate the worn portion of the rear sole at or near the instep portion of the shoe. The instep portion is an area of less importance for tractioning, stability, cushioning and shock absorbing purposes. It is important to note, however, that in embodiments other than that depicted in FIG. 1A, the rear sole need not be rotated a full 180 degrees to achieve the benefit of extended use. As long as the worn portion of the rear sole is rotated beyond the area of the initial heel strike, prolonged use of the rear sole is possible. The user can continue periodically to rotate the rear sole so that an unworn portion of the rear sole is located in the area of the first heel strike.

The shape of the rear sole 28 can be circular, polygonal, elliptical, "sand-dollar," elongated "sand-dollar" or otherwise. Preferably, the rear sole is shaped so that the rear edge of the ground-engaging surface 30 has a substantially identical profile at each rotated position. To allow for a plurality of rotatable positions, the shape of the ground-engaging surface 30 preferably should be symmetrical about at least one axis. The ground-engaging surface 30 can be planar or non-planar. Preferably, the ground-engaging surface, particularly on running shoe models, includes one or more tapered or beveled edges 48, as shown in FIG. 1A, to soften heel strike during use.

Figure 1B:
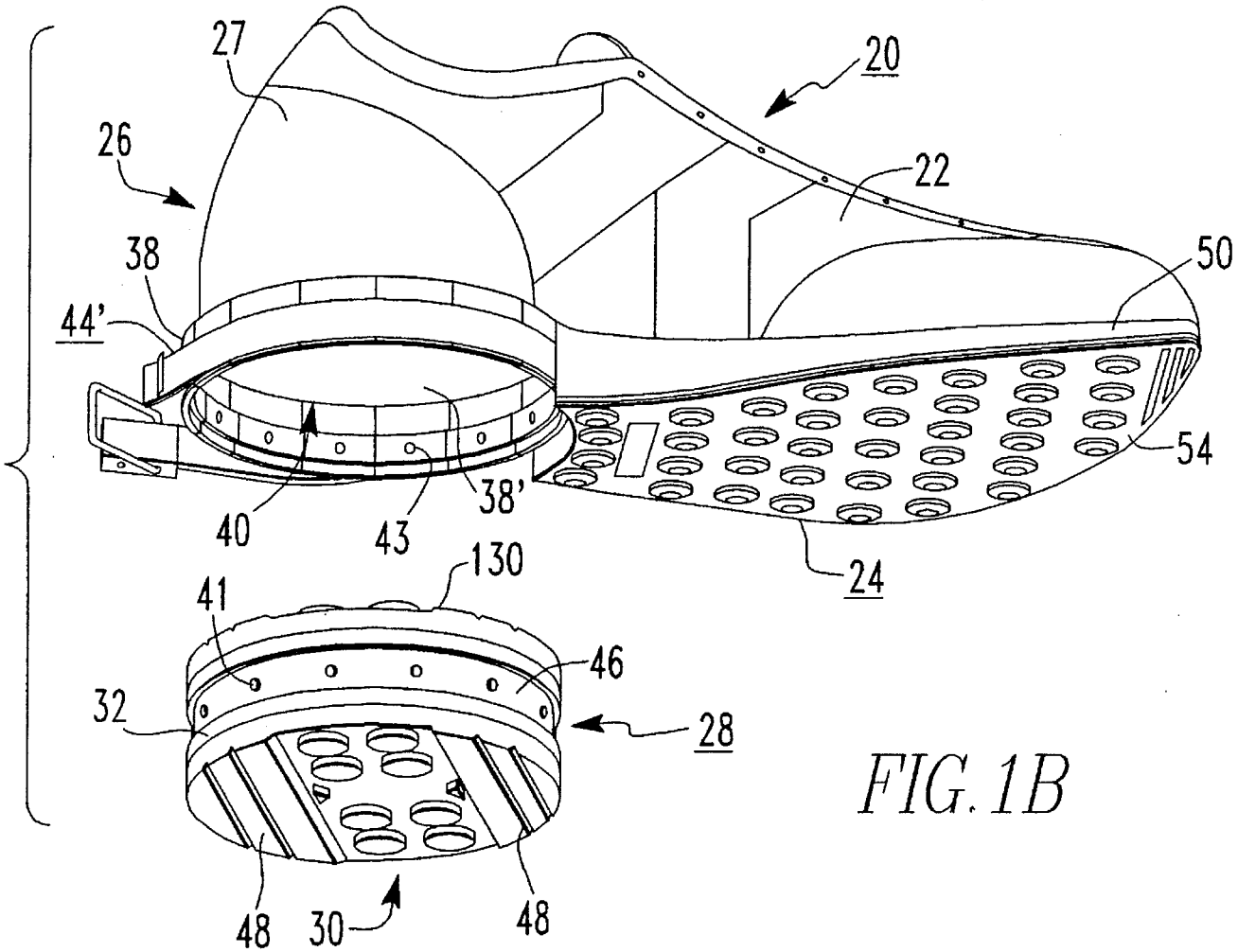
Figure 4:
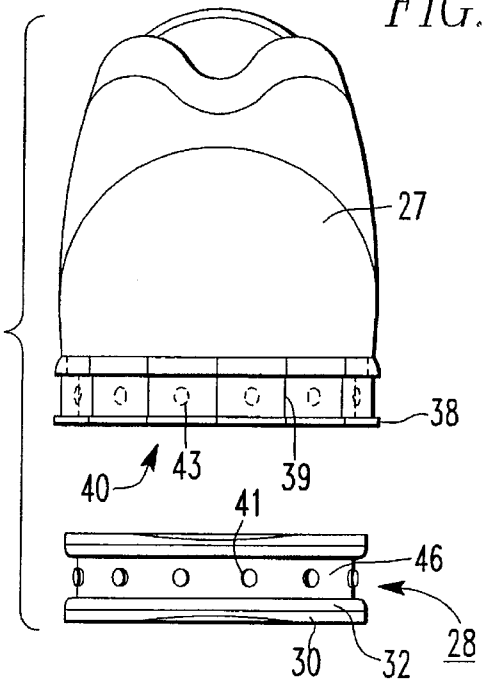
FIG. 4 is a rear elevation view of the shoe of FIG. 1A.

A plurality of compression slits 39 which run generally vertically around the periphery of the side wall 38 may be included and are shown in FIG. 1A. The slits may create a void completely through the side wall 38, or they may merely be a weakened area of the side wall, so that the side wall thickness in the area of the slit is less than the side wall thickness elsewhere. The compression slits allow the side wall to expand enough so that the rear sole can be press-fitted into the recess, as shown in FIG. 4, and then press against the peripheral surface of the rear sole to retain it in the recess. Optionally, a securing band 44 sized to fit around the side wall can be used to further secure the rear sole in the recess, as shown in FIGS. 1A and 3. The securing band may be a separate component, as shown in FIG. 1A, or made integral with the side wall 38 of the heel support, as is securing band 44' shown in FIG. 1B, thereby reducing the number of loose parts associated with the shoe.

When rotation of the rear sole 28 is desired, the user releases the band 44 (if provided), "rotates" the rear sole, and resecures the band. The rear sole is sized to allow rotation about two axes of the shoe. In addition to being rotatable about a first axis, which is normal to the major axis of the shoe, the rear sole is invertible, meaning that the sole can be rotated about a second axis that is aligned with the major axis of the shoe. In order to be invertible, the rear sole must have a first ground-engaging surface 30 located opposite a second ground-engaging surface 130. When the user desires to change the ground-engaging surface entirely, instead of merely rotating the worn spot about an axis normal to the shoe's major axis, the user detaches the rear sole and inverts it, and the first ground-engaging surface 30 assumes the relative position of the second ground-engaging surface 130, and vice-versa. Of course, the user could rotate the rear sole about both axes at the same time, if desired, when the rear sole is disengaged and re-engaged.

The side wall 38 preferably contains a first notched section 42 that extends generally horizontally along the entire periphery of the side wall 38. The securing band 44, if used, fits around the side wall 38 of the heel support and within the first notched section. Both ground-engaging surfaces of the rear sole 28 are sized to fit within and mate with the recess 40 of the heel support 26 when assembled. The horizontal mid-section of the rear sole 28 has a second notched section 46 along its periphery, and is sized to fit within and mate with the first notched section 42. After the rear sole is positioned up within the recess of the heel support, the securing band 44 fits within the first notch 42 and, upon tightening, securely holds the rear sole 28 in place during use. The compression slits 39 allow the side wall 38 of the heel support 26 to be compressed when the securing band 44 is tightened, ensuring a snug and secure fit.

As shown in FIGS. 1A and 4, located on the interior surface of the first notched section 42 is a plurality of alignment dimples 43. A plurality of alignment nipples 41 are located at corresponding positions on the exterior of the second notched section 46 of the rear sole 28. The alignment dimples 43 are sized to fit within and mate with the nipples 41 when the two sections are assembled, to help align the two sections, to help provide structural stability generally, and specifically to prevent a twisting of the rear sole in a horizontal plane within the recess 40 when the user pivots on the heel of the shoe.

When the rear sole is attached to the heel support, the beveled edges 48 are preferably aligned as shown in FIG. 2. FIG. 3 depicts a side view of an improved athletic shoe 20, where the beveled edges 48 of the ground-engaging surface, as per a running shoe model, again are depicted. Although two beveled edges are shown, the ground-engaging surface can include one or more beveled edges as desired, and they can be aligned (at an infinite number for circular rear soles) relative to the heel support as desired by the user.

Figure 5:
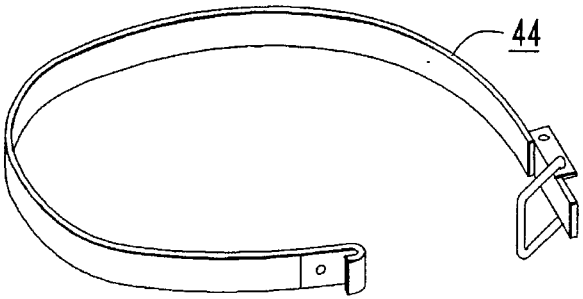
FIG. 5 is an expanded view of a securing band for the shoe of FIG. 1A.

FIG. 5 shows an expanded view of the securing band 44. The clamping assembly is similar to the conventional latch and clasp system used on most ski boots and similar equipment. The latch pivots from a first position, where the clasp is engaged, to a second and locking position, which forces the two ends of the assembly together. Similar clamping assemblies are well-known in the industry, e.g., radiator hose clamps, etc. could be used and still achieve the benefits of this invention.

The means for locking or securing the rear sole to the heel support is not limited. A secure and tight fit is required, but also the means must be easily accomplished so the user will not be required to return the shoe to the manufacturer or a shoe repair store in order to replace or remove the rear sole.

The ability to remove the rear sole serves several purposes. The user can rotate and/or invert the rear sole to relocate a worn section to a less critical area of the sole, and eventually replace the rear sole altogether when the sole is excessively worn. Additional longevity in wear may also be achieved by interchanging removable rear soles as between the right and left shoes, which typically exhibit opposite wear patterns. However, some users will prefer to change the rear soles not because of adverse wear patterns, but because of a desire for different performance characteristics. For example, it is contemplated that a person using this invention in a shoe marketed as a "cross-trainer" may desire one type of rear sole for one sport, such as basketball, and another type of rear sole for another, such as running. A basketball player might require a harder and firmer rear sole for stability where quick, lateral movement is essential, whereas a runner or jogger might tend to favor increased shock absorption features achievable from a softer, more cushioned heel. Similarly, a jogger planning a run outside on rough asphalt or cement might prefer a more resilient rear sole than the type that would be suitable to run on an already resilient indoor wooden track. Rear sole performance may also depend on the weight of the user or the cushioning desired.

Further embodiments are disclosed that show the various ways of attaching the rear sole to the heel support in accordance with the invention. The general features of the first embodiment, such as the shape of the rear sole and the material composition of the shoe elements, will apply to all embodiments unless otherwise noted.

Figure 7:
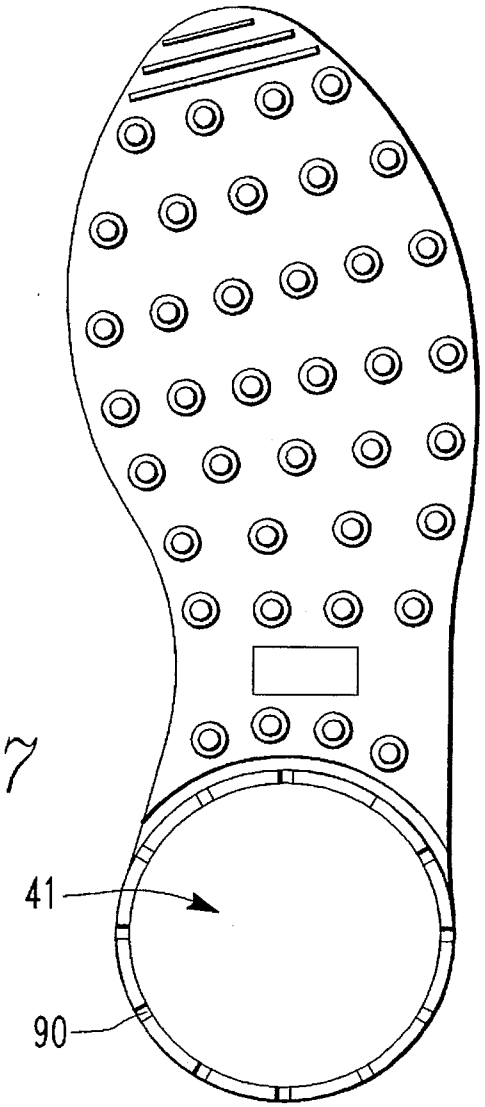
FIG. 7 is a plan view of the shoe of FIG. 6.
Figure 6:
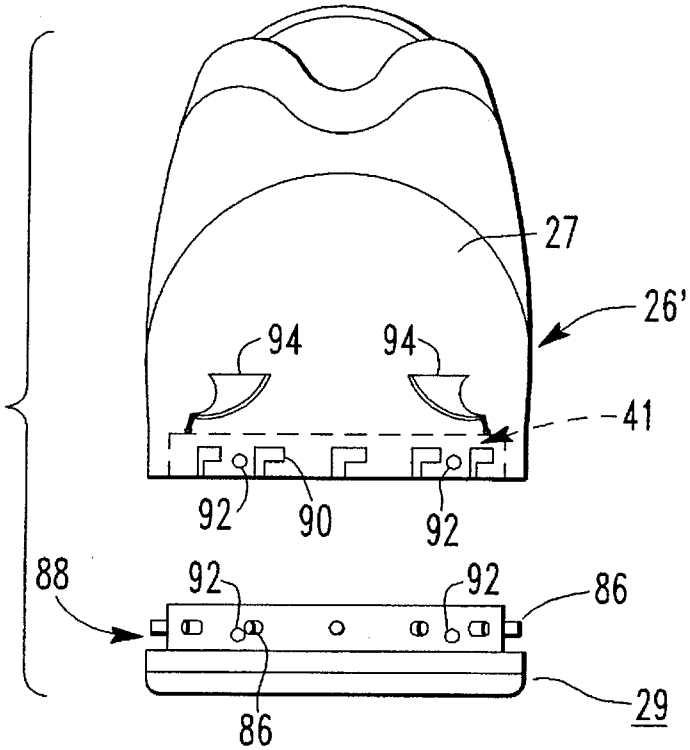
FIG. 6 is a rear elevation view of another embodiment of the shoe of the present invention.

In a second embodiment shown in FIGS. 6 and 7, a rear sole 29 has a plurality of spaced-apart protrusions 86 located along the periphery of a mating surface 88 of the rear sole 29. The protrusions 86 are sized to mate with a plurality of inverted "L"-shaped slots 90 located in a recess 41 of a heel support 26'. The slots are sized to receive the protrusions such that the rear sole is mated to the heel support by inserting the rear sole and protrusions up within the heel support recess, and rotating the rear sole about an axis normal to the major axis of the shoe to lock the protrusions into a horizontal segment of the inverted "L"-shaped slots. To further lock the rear sole into place and also to then prevent undesired rotation of the rear sole 29 within the recess 41 when the user pivots on the heel, resilient snaps 94 such as those shown in FIG. 6 may be employed. More particularly, such snaps are formed on the heel support as shown in FIG. 6 and engage apertures 92 in the wall and rear sole 29.

While the above discussion is directed towards a rear sole that rotates or separates in its entirety, it is specifically contemplated that the same benefits of this invention can be achieved if only a portion of the rear sole is rotatable or removable In this respect, "at least one rotatable ground-engaging surface" means that at least one surface of the rear sole, that contacts the ground during use, rotates or is removable. For example, this invention includes the embodiment whereby a portion of the rear sole, e.g., the center area, remains stationary while the periphery of the ground-engaging surface rotates and/or is detachable.

Figure 8A:
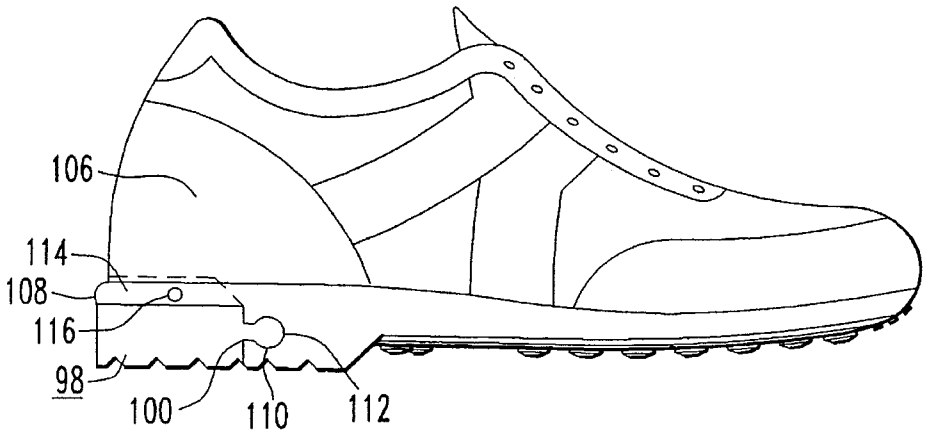
FIGS. 8A and 8B are views depicting another embodiment of the shoe of the present invention.
Figure 8B:
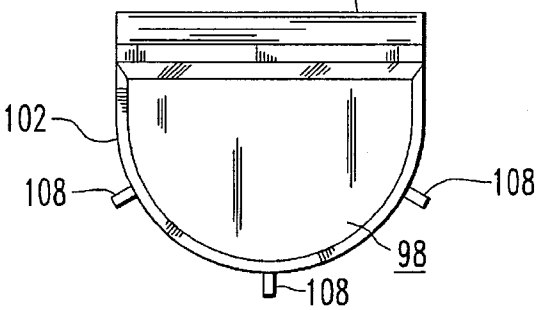

A third embodiment of the shoe of the present invention is shown in FIGS. 8A and 8B. A rear sole 98 has a transverse edge 100 and a peripheral edge 102. A tongue 110 and groove 112 mechanism secures the transverse edge 100 of the rear sole 98 to allow the rear sole to first engage the heel support 106. The tongue 110 in the embodiment shown in FIG. 8A extends the entire distance of the transverse edge 100. To assemble, the user slides the rear sole 98 in transversely to the major axis of the shoe. (Alternatively, the tongue 110 may be designed to "snap" into the groove 112 by inserting the rear sole from the rear of the shoe and directly into the groove 112.) The user then swings the rear sole 98 up to the heel support 106, using a means for securing the rear sole to the heel support so that the rear sole is securely attached. To disassemble, the process is reversed. The means for securing the rear sole is not limited; alternatives can include any of the securing means described herein, or as used conventionally in analogous applications. Alternatives can, of course, include integral locking mechanisms all around the outer periphery of the heel, such as a plurality of resilient protrusions 108 on the rear sole which engage a corresponding number of receiving apertures 116 on an overhanging portion 114 of the heel support 106. The existence of an overhanging portion 114 may require the tongue 110 to be made of a resilient material so that the rear sole 98 can bend downwards and clear the overhanging portion 114 during assembly or disassembly.

It is important to note that the rear sole of the improved athletic shoe sole of FIGS. 8A and 8B can be oriented in several different manners and still be an embodiment of this invention. The transverse edge 100 and tongue 110 may be angled in the plane of the outsole of the shoe so that they are nonperpendicular to the major axis of the shoe. This orientation will allow for a greater amount of surface contact between the tongue 110 and groove 112 than achievable if the transverse edge 100 and tongue 110 are oriented, within the plane of the outer sole, perpendicularly to the major axis of the shoe as shown in FIGS. 8A and 8B. Such orientation will also permit the isolation of the wear spot which typically occurs on the outer periphery of the heel of most runners within a smaller, removable rear sole element. A transverse edge with a different angle would achieve the same purpose for runners who tend to pronate. Also, although FIG. 8A depicts the tongue 110 extending out from the rear sole along an axis which is parallel to the major axis of the shoe, the tongue could instead extend upwards or downwards at an angle to the major axis of the shoe, and still fall within the invention described herein. In addition, the rear sole 98 need not extend, from the rear of shoe forward, the full horizontal distance of the portion of the shoe commonly referred to as the "heel portion"; rather, the benefits of this invention are achieved if, as shown in FIGS. 8A and 8B, the rear sole includes only a segment of such "heel portion". Finally, the rear sole 98 of FIGS. 8A and 8B could be rotatable about an axis aligned with the shoe's major axis, just as in the other embodiments discussed above. This feature allows the user to disengage the rear sole, "invert" or flip the rear sole about the shoe's major axis, and then re-engage the rear sole to the shoe. Consequently, the "heel strike" portion of the rear sole could be changed in this fashion.

Figure 10:
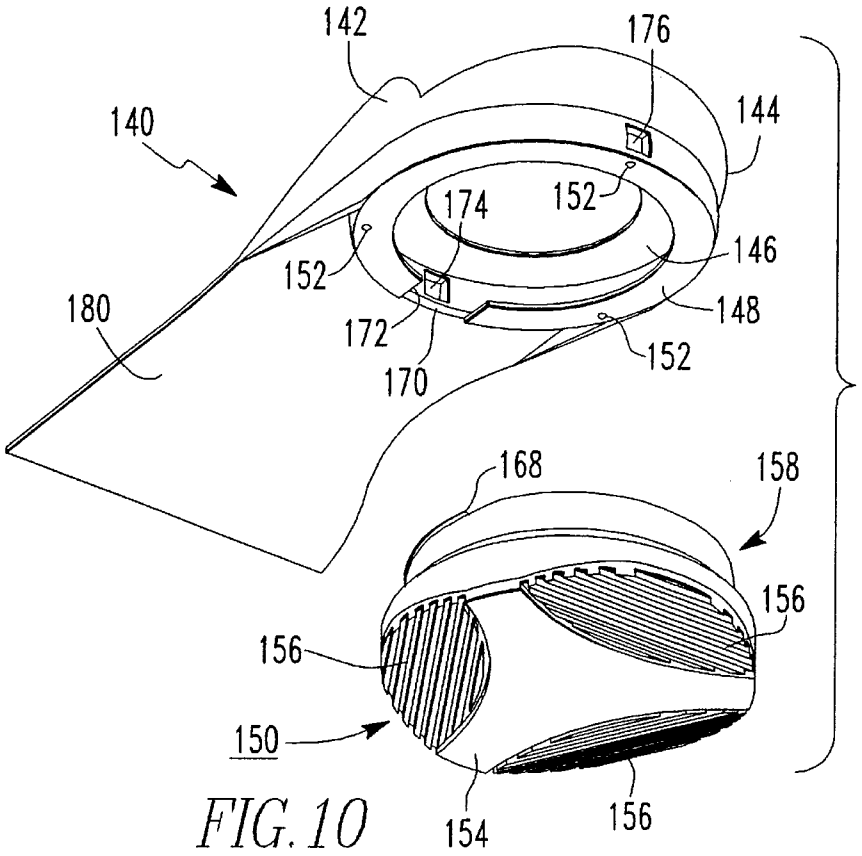
FIG. 10 is an exploded isometric view of a heel support and rear sole for the shoe of FIG. 9.

Another embodiment of the present invention is shown in FIGS. 9–12. The shoe includes an upper 22, a heel support 140, a rear sole 150, and a forward sole 160. As shown in FIG. 10, the heel support 140 includes a heel counter 142, a downwardly extending wall 144 that defines a recess 146 sized to receive the rear sole, and a rim 148 formed around the lower portion of the wall and extending inwardly into the recess. Anchors 152 may be formed on the bottom surface of the rim 148 and extend downwardly toward the rear sole 150.

Figure 12:
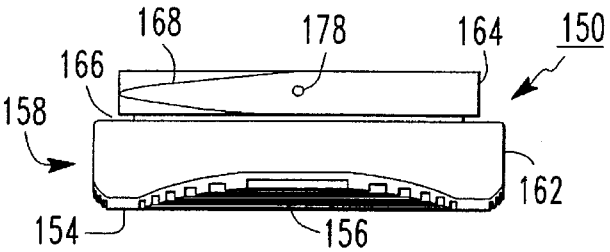
FIG. 12 is a side elevation view of the rear sole of FIG. 11.

The rear sole 150 includes a rubber ground-engaging surface 154 containing, in this embodiment, three beveled segments or edges 156. As shown in FIG. 12, the rear sole 150 also includes a midsole 158 laminated to the ground-engaging surface 154 that includes a substantially cylindrical lower portion 162 and a substantially cylindrical upper portion 164 that is smaller in diameter than the lower portion. A groove 166 is formed between these upper and lower portions and receives the rim 148 of the heel support to retain the rear sole in the heel support recess.

Figure 11:
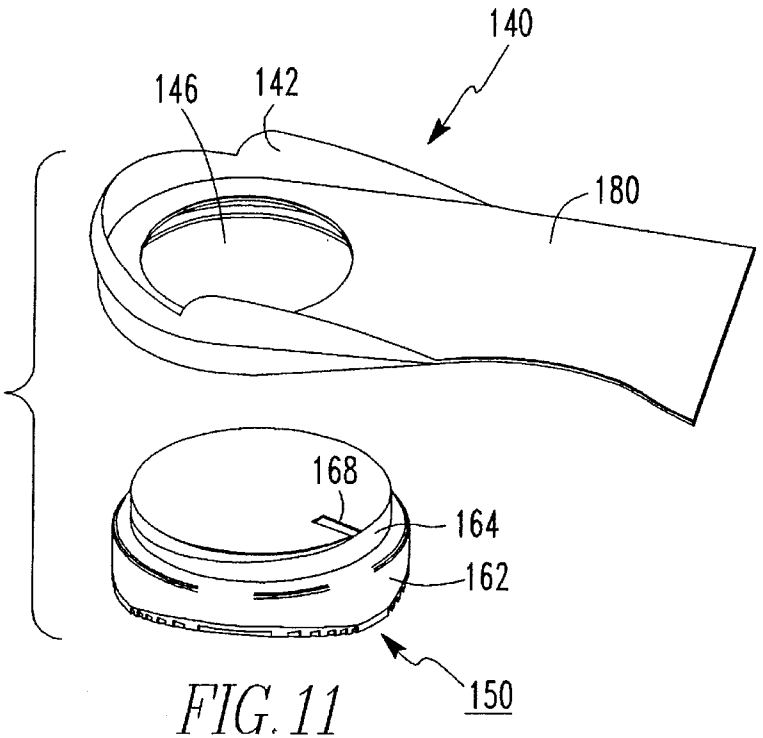
FIG. 11 is another exploded isometric view of the heel support and rear sole of FIG. 10.

The upper midsole portion 164 includes a spiral groove 168, as shown in FIGS. 10–12, that allows the rear sole to be screwed into the heel support. As shown in FIG. 10, a portion of the rim of the heel support is cut away at 170. The rear sole is screwed into the heel support by aligning the top of the spiral groove with an edge 172 of the rim adjacent the cut-away portion. A sharp instrument (such as a slender screwdriver), inserted through the window 174 and into the top of the spiral groove 168 may aid in the start-up process. The rear sole is then simply rotated, and the rim engages the spiral groove of the rear sole to screw the upper midsole of the rear sole into the recess. Once fully inserted, the rear sole may be rotated freely within the recess by hand, albeit with desired resistance. When the rear sole is attached to the heel support, the optional anchors sink into the lower midsole portion of the rear sole due to the weight of the user to prevent rotation of the rear sole during use.

It should be noted that the configuration of the midsole 158, i.e., the upper midsole portion having a diameter equal to or slightly larger than that of the recess defined by the rim and a lower midsole portion having a diameter substantially equal to the diameter defined by the circular wall 144, further eliminates any vertical gapping problems from occurring between the wall of the heel support and the peripheral surface of the rear sole.

To assist in removing the rear sole from the heel support, the two windows 174, 176 (FIG. 10) are formed in the wall of the heel support, a first window 174 above the cut-away portion of the rim and a second window 176 positioned 180° around the wall of the heel support from the first window. In addition, a small indention 178 is formed on the peripheral surface of the upper midsole portion 164 at a position 180° from the point at which the spiral groove 168 intersects the bottom of the upper midsole portion 164, as shown in FIG. 12. To remove the rear sole from the heel support, the rear sole is rotated in the heel support until the small indention appears in the second window 176. At this point, the bottom of the spiral groove is aligned with the center of the cut-away portion. The user, again using a screwdriver or similar instrument inserted through the window 174 into the spiral groove 168, can then simply rotate the rear sole so that the rim of the heel support engages the spiral groove. The rear sole is then simply rotated to screw the rear sole out of the heel support.

Figure 13:
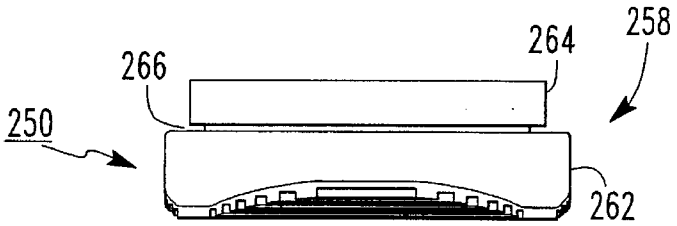
FIG. 13 is a side elevation view of another rear sole that can be used in the embodiment shown in FIG. 11.

It is not necessary to include a spiral groove in the rear sole for attaching and removing the rear sole from the heel support. As shown in FIG. 13, a rear sole 250 is similar to that shown in FIG. 12, but includes no spiral groove and no small indention. Because the upper portion 264 and lower portion 262 of the midsole 258 are made of a soft material, it can be press-fitted into the recess of the heel support until the rim 148 engages the groove 266. In this instance, the rim of the heel support need not include the cut-away portion or the windows, as shown in FIG. 10, and can be a continuous rim, as shown in FIGS. 14–19. In this instance, the heel support may be made of a plastic or other material that is flexible enough to allow a slight expansion of the recess so that the rear sole can be press-fitted into position. Alternatively, the wall or rim may include compression slits similar to those shown in FIG. 1A. Still another alternative is for the rim to be slightly narrower (shown), to accommodate the press-fit.

As shown in FIGS. 10 and 11, the heel counter 142 extends upwardly from the heel support and is attached to the heel portion of the upper by gluing or other conventional methods. The heel counter is preferably made of the same material as the heel support and is preferably molded to be integral with the heel support. The heel counter serves to stabilize lateral movement of the heel during use.

Figure 9:
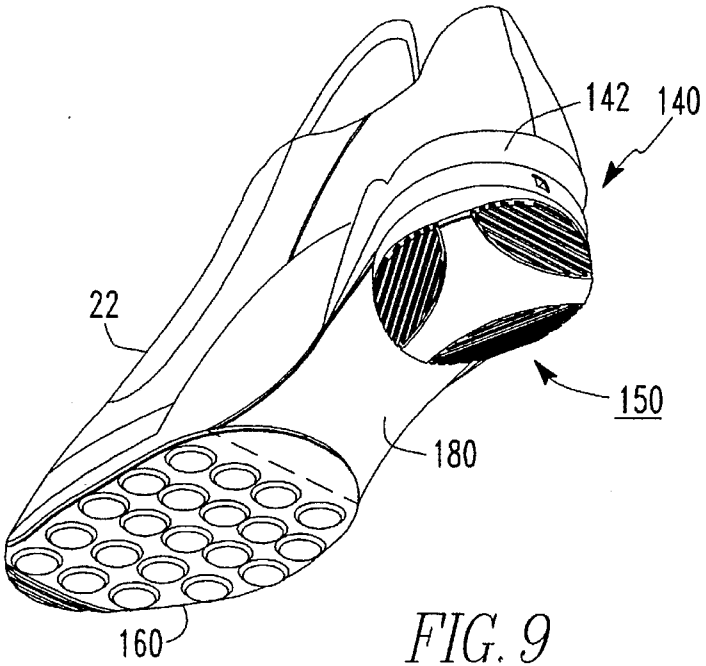
FIG. 9 is an isometric view of another embodiment of the shoe of the present invention.

As shown in FIGS. 9–11, the shoe of the present invention also preferably includes an arch bridge 180 attached to, and integral with, the heel support 140 to provide an even firmer support for the arch of the foot and for alleviating potential gapping problems where the wall of the heel support is adjacent the forward sole. The an arch bridge 180 generally extends from the rear of the recess 146 (where it attaches to the heel counter 142 and side wall 144) to the ball of the foot and is attached to the upper 22 and forward sole 160 by gluing or other conventional methods. The arch bridge 180 also is preferably composed of the same material as the heel support and is made integral with the heel support 140 by molding. Such one-piece construction of the arch bridge together with the heel support solves another major problem, and that is the tendency of an athletic shoe of conventional "full body" arch construction to curl at the juncture of the hard heel support with the resilient forward sole.

Figure 15:
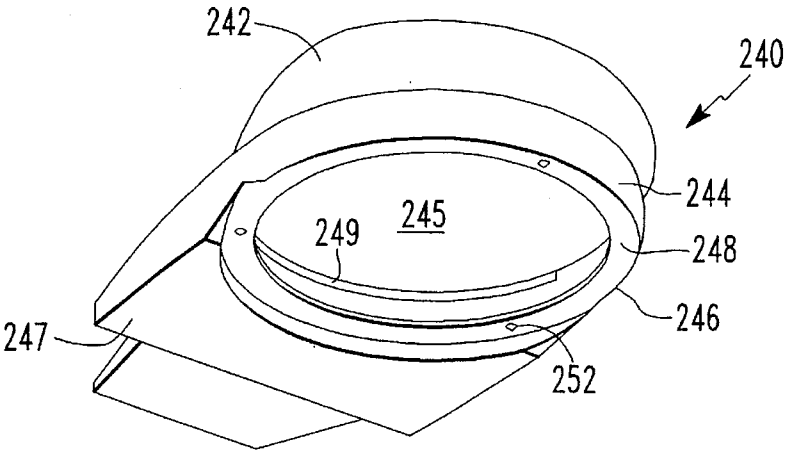
FIG. 15 is an isometric view of a heel support for the shoe of FIG. 14.
Figure 16:
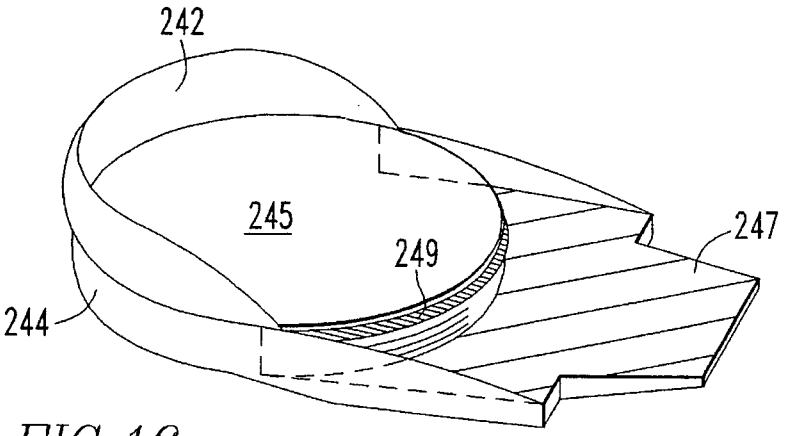
FIG. 16 is another isometric view of the heel support of FIG. 15.
Figure 14:
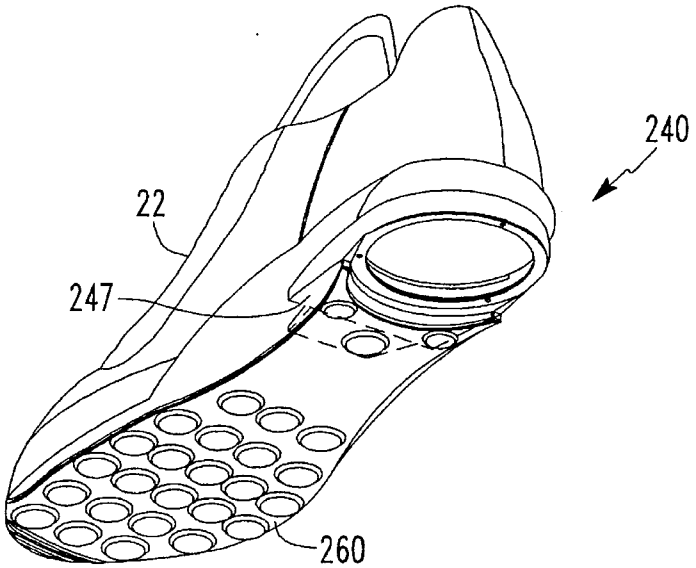
FIG. 14 is an isometric view of another embodiment of the shoe of the present invention.

As shown in FIGS. 14–16, another embodiment of a heel support 240 includes a heel counter 242, a vertically extending side wall 244 that defines a recess 246, and a generally horizontal, continuous rim 248 extending inwardly into the recess. Anchors 252 may be formed on the bottom of the rim and engage the lower midsole portion 262 of the rear sole 250 shown in FIG. 13 to prevent rotation of the rear sole during use.

In this embodiment, the heel support 240 may include a generally horizontal top wall 245 positioned above the side wall 244 to support the heel portion of the upper 22. The top wall 245 is preferably composed of plastic and is made integral with the heel support. A gap 249 is preferably formed between the top wall 245 and a portion of the side wall 244 to enable the user not to feel the front side wall 244 beneath his or her foot. An optional hole (not shown) may be cut in the top wall 245 as in FIG. 10 to allow the user's foot to have direct contact with the center of the midsole.

As an alternative to using the arch bridge 180, the heel support 240 includes a thickened tongue 247 that extends toward the ball of the foot. The thickened tongue 247 provides additional gluing surface for attaching the heel support to the forward sole 260 and additional stiffness to the heel portion of the shoe and the arch area, thus minimizing the chances of separation of the forward sole from the heel support, and at the same time minimizing the tendency of the shoe to curl at the juncture of the hard heel support with the soft forward sole.

Figure 18:
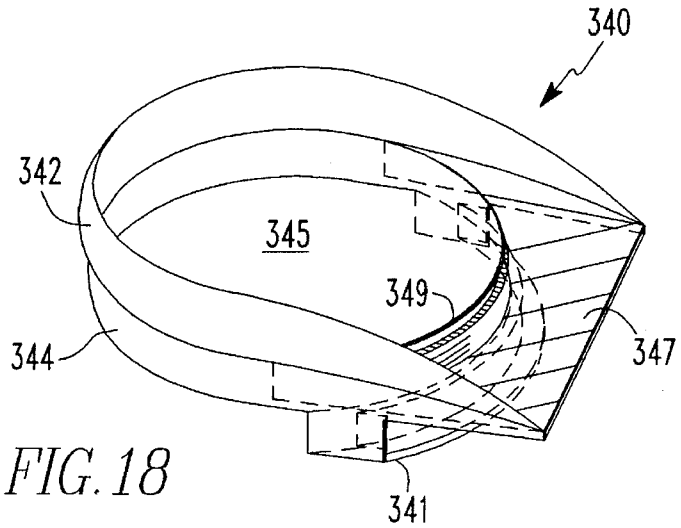
FIG. 18 is an isometric view of a heel support for the shoe of FIG. 17.
Figure 19:
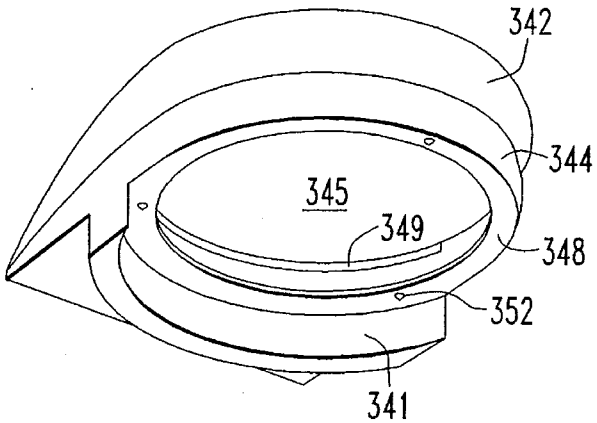
FIG. 19 is another isometric view of the heel support of FIG. 18.
Figure 17:
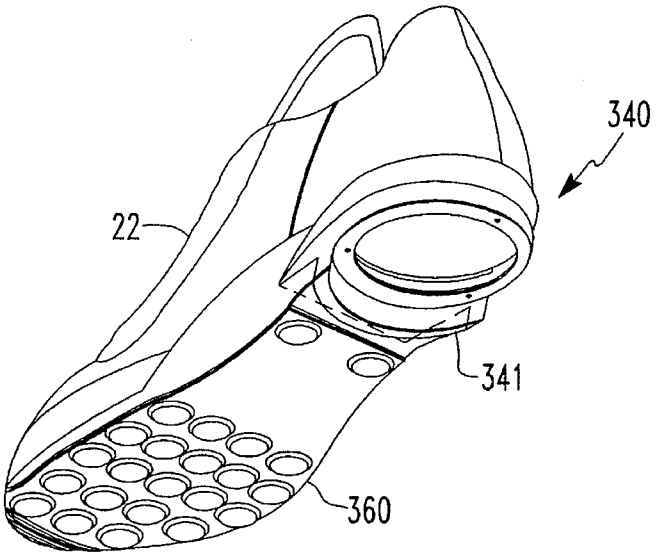
FIG. 17 is isometric view of another embodiment of the shoe of the present invention.

Another embodiment of the heel support is shown in FIGS. 17–19. In this embodiment, a heel support 340 includes a heel counter 342, wall 344, rim 348, top wall 345, gap 349, and anchors 352 similar to those shown in FIGS. 14–16. The tongue 347 is thinner and slightly smaller than the tongue 247 shown in FIGS. 14–16. However, the heel support, as shown in FIGS. 17 and 18, includes a curved wall 341 that has a pocket formed on its forward side for receiving a mating rear edge of the forward sole 360 adjacent the heel support. The curved wall 341 provides a firm, smoothly contoured transition from hard-to-align resilient materials of the forward and rear soles and thereby minimizes gapping. It also provides a desirable brace or bumper for the lower portion of the rear sole when the user is running.

Figure 20A:
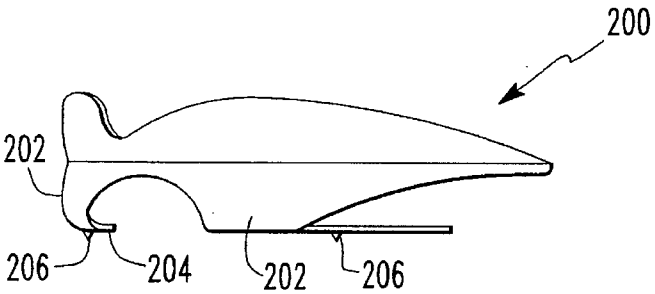
FIGS. 20A and 20B are side elevation and plan views, respectively, of another embodiment of the heel support for the shoe of the present invention.
Figure 20B:
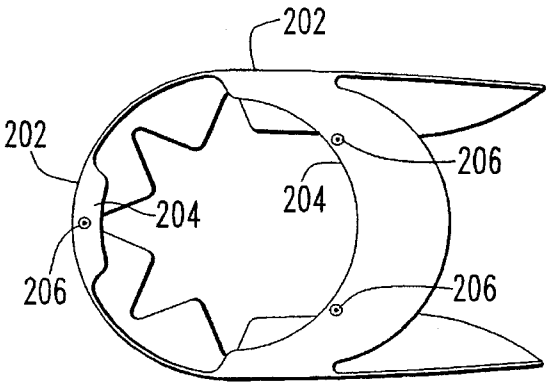

Although several of the embodiments show a heel support having a continuous wall that defines a recess, a continuous wall is not required. As shown in FIGS. 20A and 20B, a heel support 200 may include two or more spaced-apart wall portions 202 that extend downwardly to at least partially define a recess. These wall portions each include a rim 204 that extends into the recess in a manner similar to the previous embodiments. The rear sole shown in FIG. 13 can be slid and press-fitted into the recess, and the rims formed on the downwardly extending walls of the heel support engage the groove 266 to retain the rear sole in the recess, with anchors 206 preventing rotation of the rear sole during use. The spacing between the wall portions preferably occurs where wear spots are typically formed on the rear sole to provide extra cushioning at the wear spots.

Figure 23:
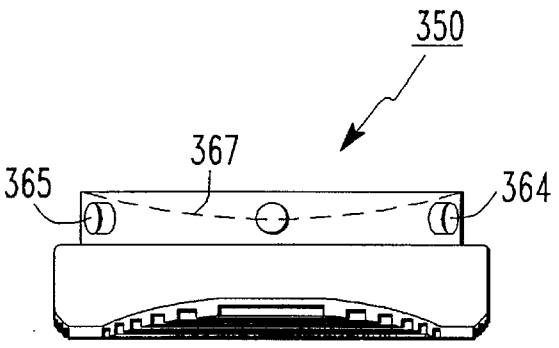
FIG. 23 is a side elevation view of the rear sole of FIG. 22.
Figure 22:
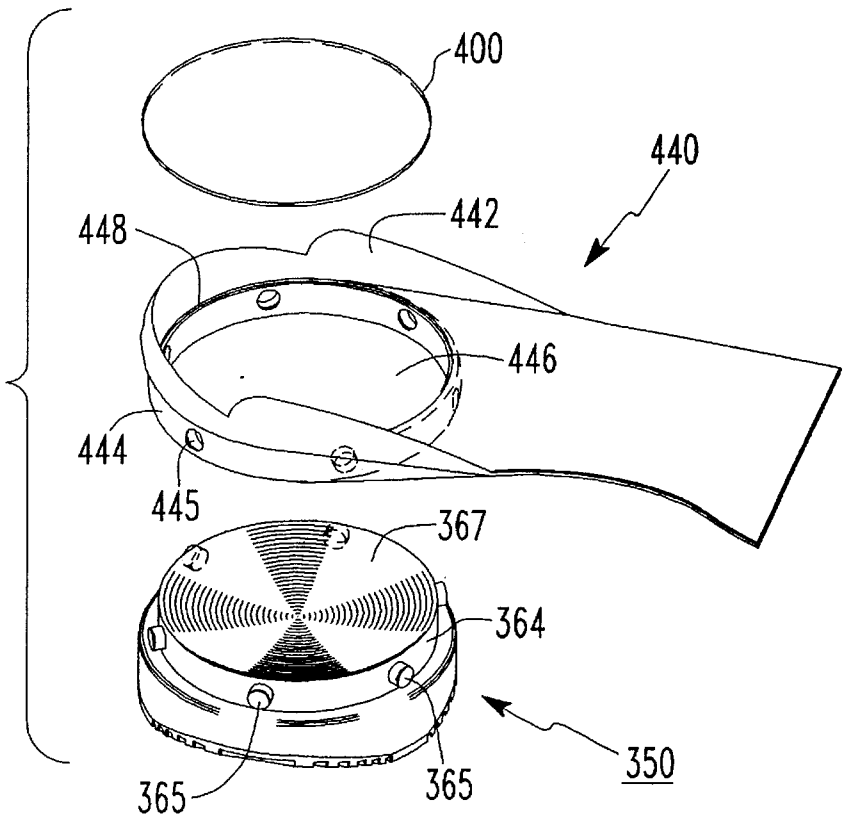
FIG. 22 is an exploded isometric view of a heel support, rear sole, and graphite insert for use in the shoe of the present invention.

Another manner of attaching the rear sole to the heel support is shown in FIGS. 22 and 23. In this embodiment, the upper midsole portion 364 includes a plurality of resilient knobs 365 extending from its peripheral surface. The knobs may be cylindrical as shown or any geometrical shape that will prevent rotation of the rear sole, including those knobs shown in FIG. 35. In addition, the heel support 440 includes a side wall 444 that has a plurality of openings 445 that receive the knobs 365.

Figure 21:
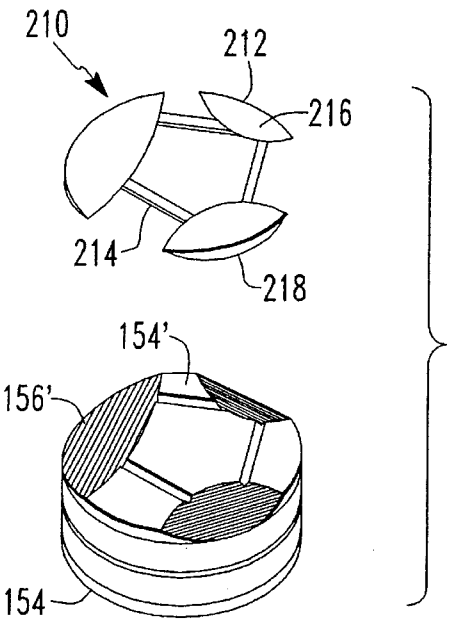
FIG. 21 is an exploded isometric view of a rear sole and wafer for the shoe of the present invention.

As previously discussed, in addition to being rotatable, the rear sole may also be invertible. In this instance, the rear sole would have two ground-engaging surfaces composed of rubber compound. If each ground-engaging surface also includes one or more beveled surfaces, the heel support of the upper must be molded to account for the beveled surfaces of the ground-engaging surface that is not in use. Alternatively, as shown in FIG. 21, a wafer 210 may be positioned between the ground-engaging surface that is not in use and either the top of the heel support or the bottom of the upper. As shown in FIG. 21, the wafer includes inserts 212, the number of which corresponds to the number of beveled edges 156', joined by bars 214. Each insert has a flat top surface 216 and a bottom surface 218 that conforms to the shape of the beveled surfaces to effectively provide a rear sole that has a flat top surface. As a result, the rear sole is effectively stabilized when the heel of the shoe strikes the ground during use, and the rear sole can be rotatably positioned in an infinite number of positions, which cannot occur if the top horizontal wall of the recess is simply molded to mate with the surface of the invertible rear sole that is not in use, as contemplated by FIG. 1A and 1B.

As also shown in FIGS. 22 and 23, an insert 400 made of graphite or other stiff, but flexible, material is supported by the heel support side walls 444 and positioned between the rear sole and the heel portion of the upper (not shown) of the shoe, among other things, to reduce heel-center midsole compression. As shown in FIG. 22, the circular graphite insert 400 has a diameter that is slightly larger than the diameter of the recess 446 defined by the downwardly extending wall 444 of the heel support 440. A lip 448 is formed between the inner surface of the heel counter 442 and the recess 446 to support the periphery of the insert.

The graphite insert can either be permanently attached to the top of the heel support or removable through a pocket formed in the canvas-type material typically located on top of the heel support (not shown) or it can be simply removed after removing the sock liner where no such canvas material is employed. The removability of the graphite insert allows the use of several different types of graphite inserts of varying stiffness or composition and, therefore, can be adapted according to the weight of the runner, the ability of the runner, the type of exercise involved, or the amount of spring desired in the heel of the shoe.

As shown in FIGS. 22 and 23, the rear sole 350 preferably has a concave top surface 367. Therefore, when the rear sole is attached to the heel support, the top surface of the rear sole does not come into contact with the graphite insert. As a result, the middle of the graphite insert can flex under the weight of the runner, and thus acts like a trampoline to provide extra spring in the user's gait in addition to preventing midsole compression.

Figure 24:
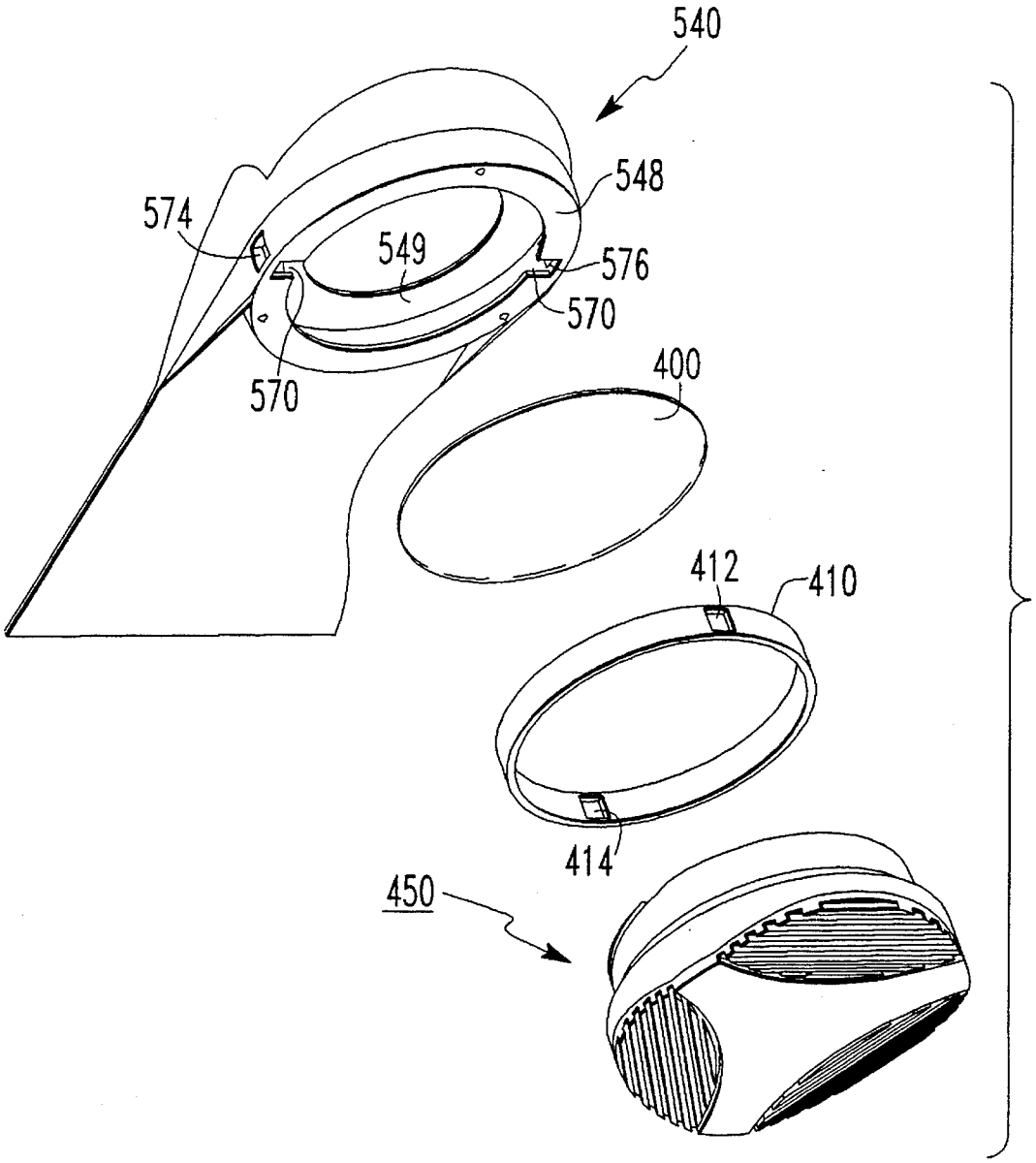
FIG. 24 is an exploded isometric view of a heel support, graphite insert, and rear sole for use in the shoe of the present invention.

Another embodiment for attaching the graphite insert is shown in FIG. 24. In this embodiment, the graphite insert 400 is inserted through the bottom of the heel support 540 so that the periphery of the graphite insert presses against the lower surface of an upper rim 549 of the heel support. A plastic ring 410 is also inserted in the recess between the graphite insert and the rim 548. Such ring 410 is flexible enough to allow it to be inserted into the heel support. The ring supports the periphery of the lower surface of the graphite insert. The rear sole 450 is a screw-in type identical to the rear sole 150 shown in FIG. 12 except that it has a concave top surface (like the top surfaces shown in FIGS. 30 and 33) to allow the graphite insert to flex during use.

As shown in FIG. 24, the rim 548 of the heel support includes two cut-away portions at 570 and windows 574, 576 to allow the graphite insert and the ring to be inserted into the recess of the heel support, in addition to allowing the rear sole to be screwed onto the heel support in the same manner as contemplated by FIGS. 10, 11 and 12. The ring 410 also has windows 412, 414 that are aligned with the windows 574, 576 when the ring is inserted into the recess.

Figure 25:
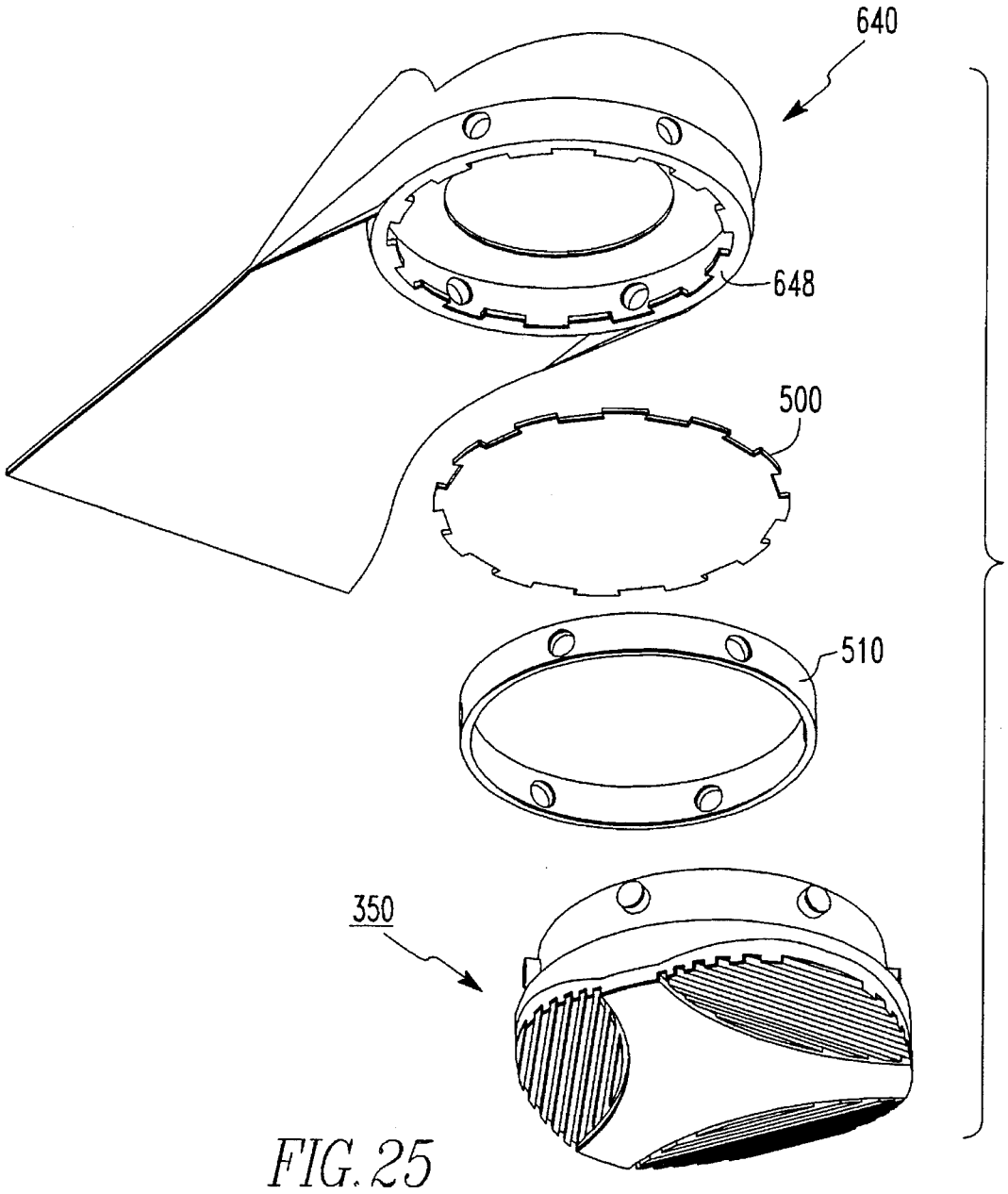
FIG. 25 is an exploded isometric view of another embodiment of a heel support, graphite insert, and rear sole for use in the shoe of the present invention.
Figure 26:
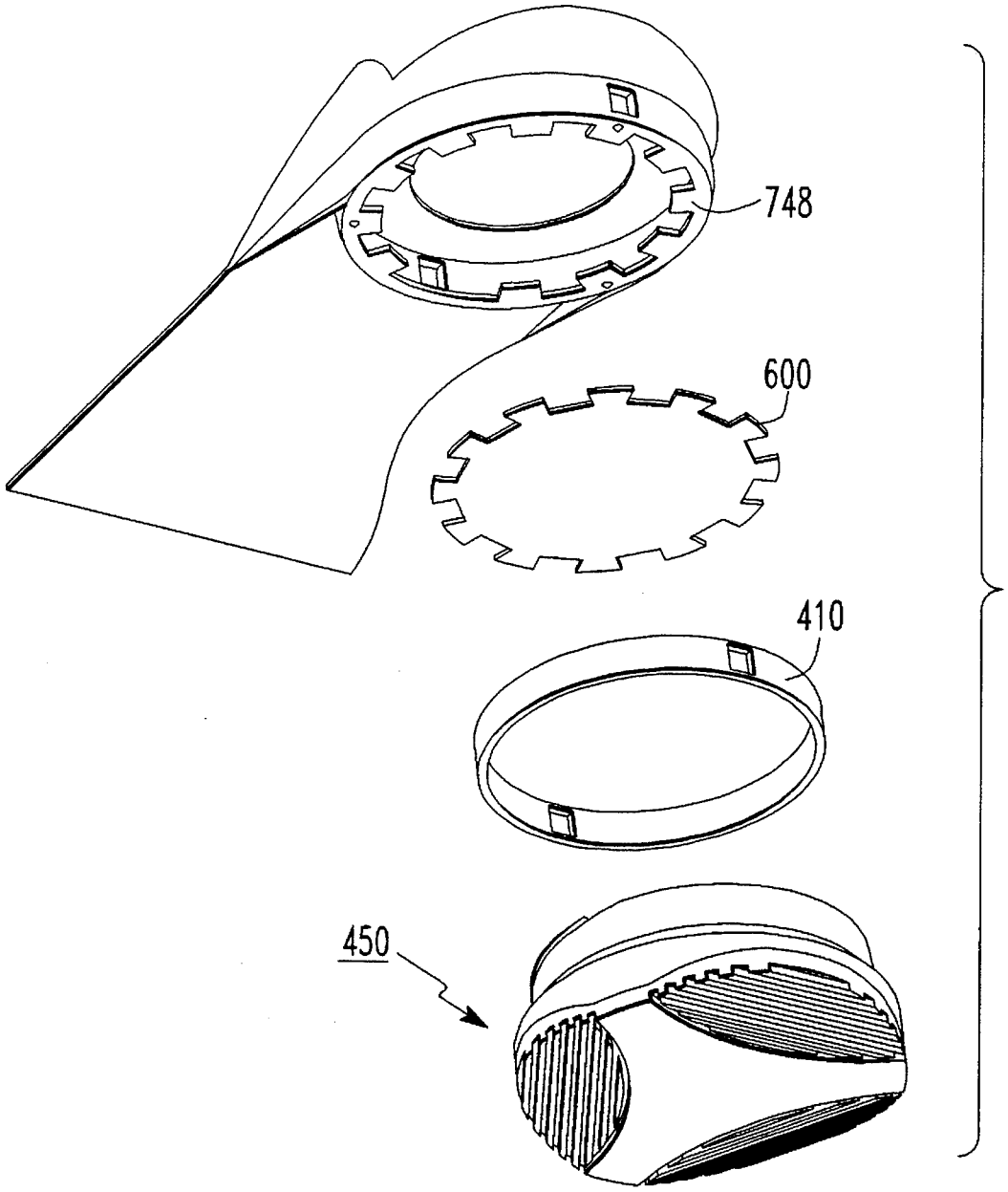
FIG. 26 is an exploded isometric view of another embodiment of the heel support, graphite insert, and rear sole for use in the shoe of the present invention.

Alternatively, the rim 648 and 748 of the heel support and the graphite insert 500 and 600 can be "gear-shaped", as shown in FIGS. 25 and 26, to allow the graphite insert 500 and 600 to be inserted into the heel support. Again, the ring 510 is flexible enough to allow it to be inserted into the heel support.

Figure 27:
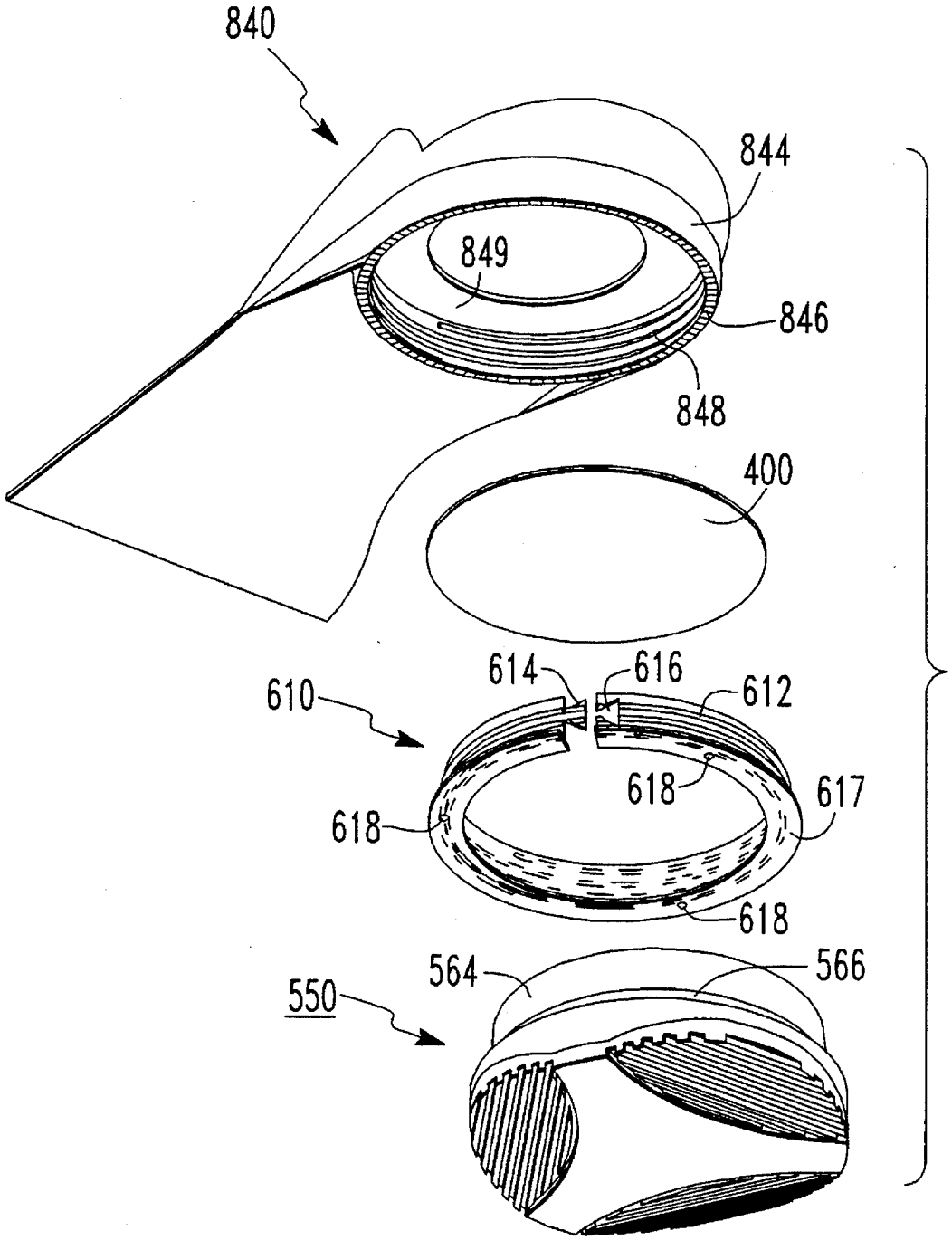
FIG. 27 is an exploded isometric view of another embodiment of the heel support, graphite insert, and rear sole for use in the shoe of the present invention.

A further embodiment is shown in FIG. 27. In this embodiment, a rear sole 550 is identical to the rear sole 250 shown in FIG. 13 except that it has a concave top surface as in FIGS. 30 and 33. A heel support 840 includes a downwardly extending wall 844 that has a serrated bottom edge 846 and a threaded inner surface 848. The heel support 840 also includes an upper rim 849.

A threaded ring 610 includes a threaded outer surface 612 that mates with the threaded inner surface 848 of the heel support 840. The ring also includes an outwardly and inwardly extending flange 617 that presses against the serrated bottom edge 846 when the ring is screwed into the heel support. The bottom surface of the flange 617 includes anchors 618, and may also be serrated to further grip the rear sole to prevent rotation. The ring also has two ends 614 and 616, with end 614 having a male member and end 616 shaped to receive the male member to lock the two ends together.

The rear sole 550 is attached to the heel support by unlocking the ends of the ring and positioning the ring around the upper midsole portion 564 of the rear sole such that the flange 17 engages groove 566 of the rear sole. The ring 610 is then firmly locked onto the rear sole by mating end 614 with end 616. The graphite insert 400 is inserted into the heel support so that it presses against the upper rim 849. The ring 610, with the rear sole 550 attached, is then screwed into the heel support by engaging the threaded surface 612 of the ring with the threaded surface 848 of the wall 844. The ring is then screwed into the heel support until the serrated edge 846 of the wall 844 engages the flange 617 of the ring 610. The serrated edge 846 serves to prevent rotation of the ring during use.

Figure 28:
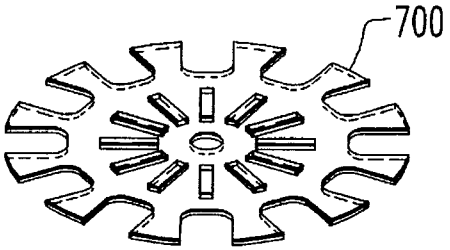
FIG. 28 is an isometric view of a graphite insert for use in the shoe of the present invention.

The graphite insert is not limited to a circular graphite insert and can be adapted to conform to the shape of the rear sole. In addition, the graphite insert may be concave or convex in shape and may include cut-out portions such as those in the graphite insert 700 shown in FIG. 28, to provide additional spring. The graphite insert also need not be used only in conjunction with a detachable rear sole, but can be used with permanently attached rear soles as well.

Figure 30:
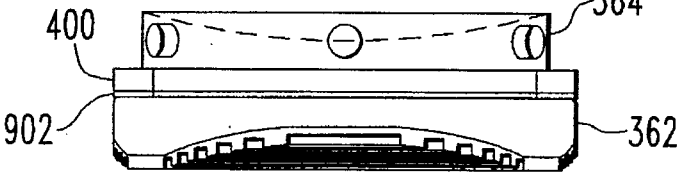
FIG. 30 is a side elevation view of the rear sole and elastic band of FIG. 29.
Figure 29:
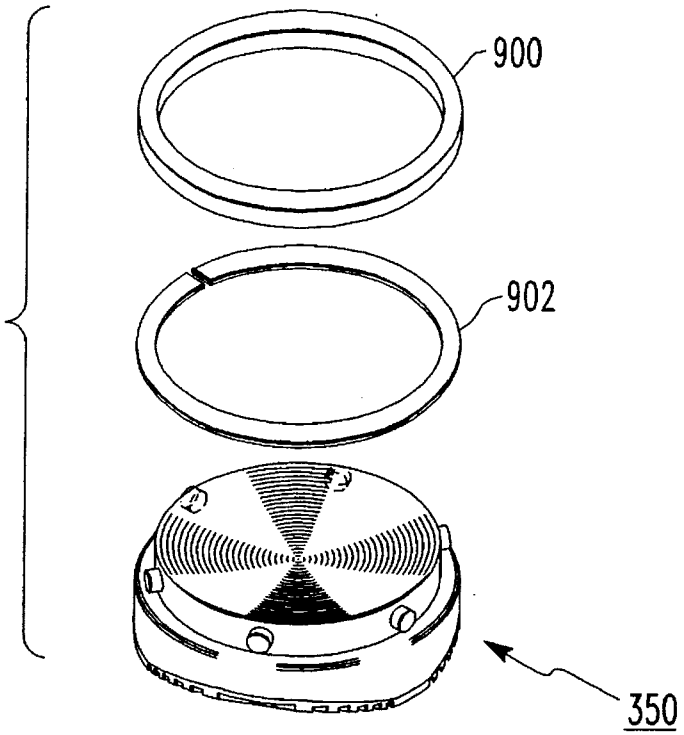
FIG. 29 is an exploded isometric view of a rear sole and elastic band for use in the shoe of the present invention.

Another approach to providing additional spring and/or increasing heel cushioning is shown in FIGS. 29 and 30. In this embodiment, a highly resilient band 900, stretched to fit over the upper portion of the rear sole, rests on the top surface of the lower midsole portion 362. A hard plastic or graphite O-ring 902 may be provided between the band 900 and the top surface to enhance the spring effect. The top of the band, when the rear sole is attached to a heel support, such as heel support 440 shown in FIG. 22, is positioned against the lower edge of the wall 444. Thus, when the heel of the shoe strikes the ground during use, the force exerted by the wall of the heel support is directly applied to the resilient band rather than the cushiony midsole, thereby providing additional spring. Alternatively, the band 990 may be air-filled, gas-filled, or gel-filled and still achieve the same effect.

Figure 32:
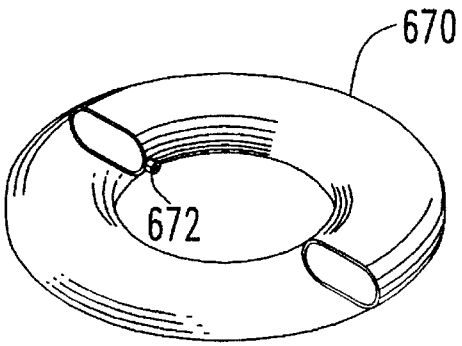
FIGS. 31–33 are views of a rear sole for use in the shoe of the present invention.
Figure 33:
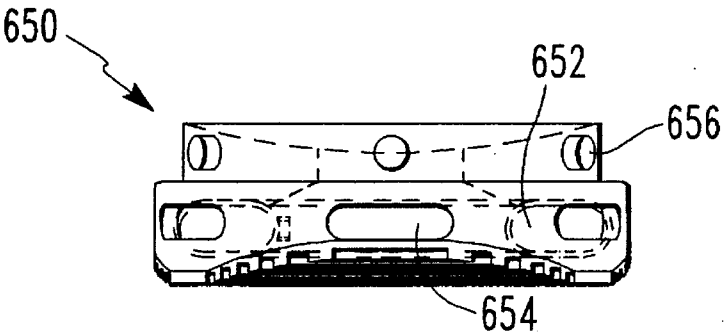
Figure 31:
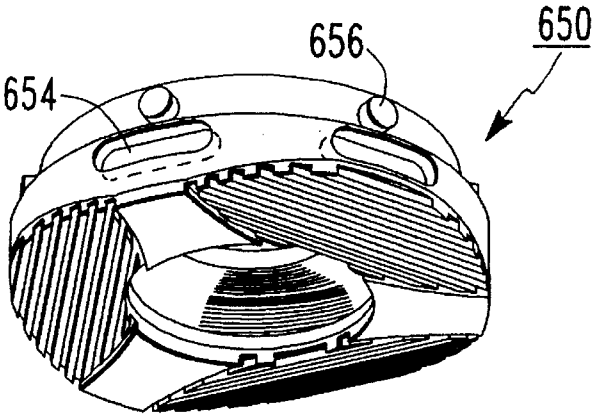

If additional cushioning is desired, the rear sole can be modified as shown in FIGS. 31–33. In this embodiment, a "doughnut-shaped" void 652 is created in the middle of a rear sole 650 to support an air-filled cushion 670 similar in shape to an inner tube for a tire. In addition, several voids 654 are formed around the periphery of the rear sole to reduce the weight of the rear sole and better exploit the cushioning properties of the air-filled cushion 670 when the shoe strikes the ground during use. The voids are preferably positioned directly below the knobs 656 to cushion the force transmitted from the heel support to the knobs. The air cushion 670 may include a valve 672 for inflating and deflating the cushion.

Figure 34:
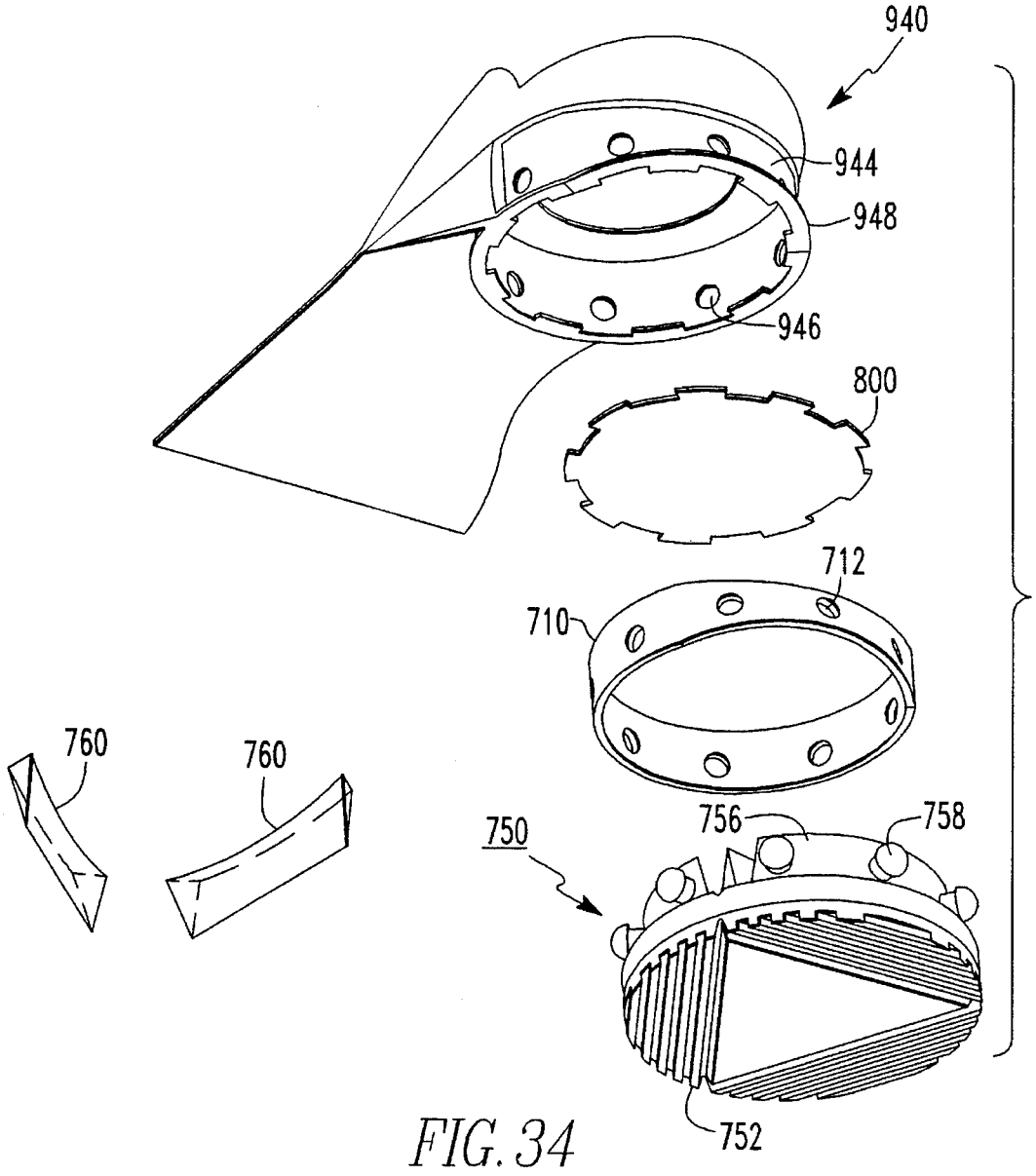
FIG. 34 is an exploded isometric view of another embodiment of the heel support, graphite insert, and rear sole for use in the shoe of the present invention.
Figure 36:
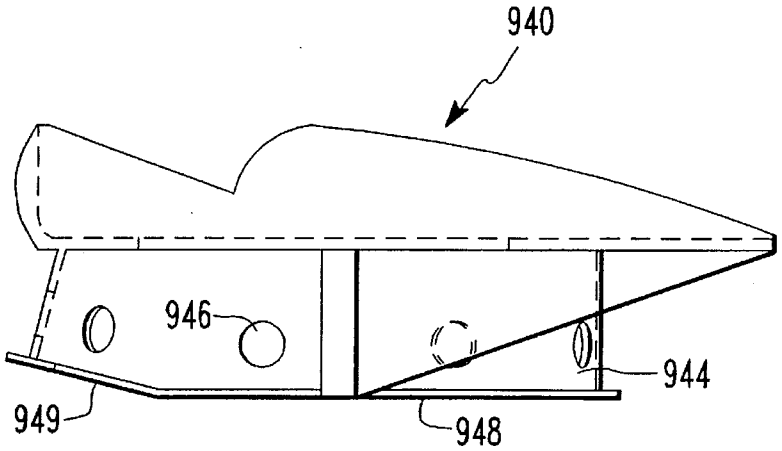
FIG. 36 is a side elevation view of the heel support of FIG. 34.
Figure 35:
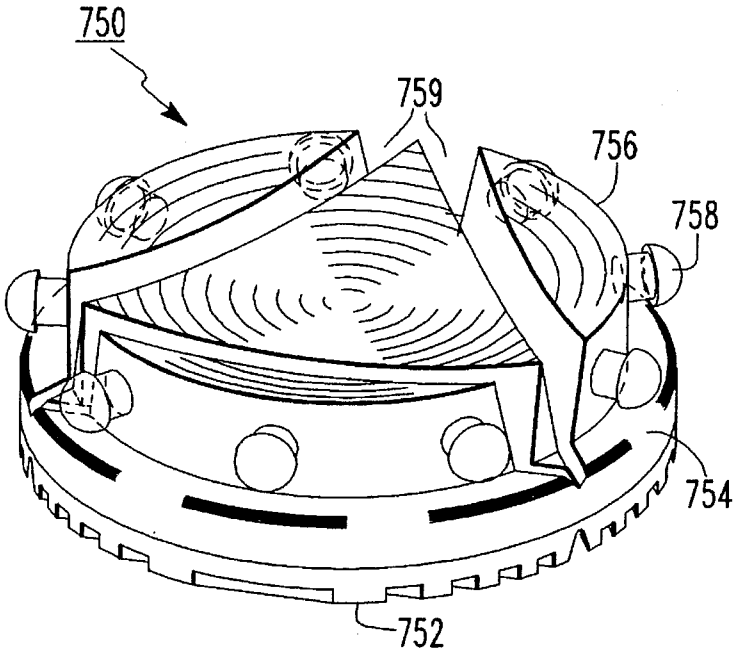
FIG. 35 is an isometric view of the rear sole of FIG. 34.

Another embodiment is shown in FIGS. 34–36 and includes a heel support 940, a graphite insert 800, a ring 710, and a rear sole 750. As shown in FIG. 35, the rear sole 750 includes a substantially planar ground-engaging surface 752, a lower midsole portion 754, and an upper midsole portion 756. A plurality of knobs 758 having bulbous end portions are formed around the periphery of the upper midsole portion 756. In addition, three voids 759 are formed in the upper midsole portion 756 and a portion of the lower midsole portion 754.

As shown in FIG. 36, the heel support 940 includes a downwardly extending wall 944 that contains a plurality of openings 946 for receiving the knobs 758. The heel support 940 also includes a rim 948 having a rearward bent portion 949. Given this configuration, the ring 710, which also has a plurality of openings 712 that are aligned with the openings 946 of the heel support, and the graphite insert 800 are shaped accordingly to fit within the recess of the heel support.

The graphite insert 800 and the ring 710 are inserted into the recess of the heel support and the rear sole 750 is press-fitted into the recess so that the knobs 758 of the rear sole engage the openings 946 formed in the wall 944 of the heel support. Since the rim of the heel support is bent, the portion of the rear sole adjacent the bent rim will also be bent upwardly to effectively create a beveled edge on the ground-engaging surface. The voids 759 created in the rear sole allow the rear sole easily to be bent to conform to the shape of the bent rim. Wedges 760 may be inserted into the voids of the rear sole that are not adjacent to the bent rim to provide lateral support.

It will be apparent to those skilled in the art that various modifications and variations can be made in the system of the present invention without departing from the scope or spirit of the invention. Thus, it is intended that the present invention cover the modifications and variations of this invention provided they come within the scope of the claims and their equivalents.

What is claimed is:

1. A shoe comprising:

an upper having a heel region;

a rear sole secured below the heel region of the upper; and a flexible plate having upper and lower surfaces and supported between at least a portion of the rear sole and at least a portion of the heel region of the upper, peripheral edges of the plate being restrained from movement in a direction substantially perpendicular to a major axis of the shoe so that an interior portion of the plate is deflectable relative to the peripheral edges in a direction substantially perpendicular to the major axis of the shoe.

2. The shoe of claim 1, wherein the flexible plate is supported at its periphery.

3. The shoe of claim 1, including a heel support having at least one wall extending downwardly from the upper to at least partially define a recess, the rear sole secured in the recess of the heel support.

4. The shoe of claim 3, further including a member interconnecting the rear sole with the heel support.

5. The shoe of claim 4, wherein the member includes one of an indention and protrusion for engaging the other one of a protrusion and indention on the heel support wall to attach the member and rear sole to the heel support.

6. The shoe of claim 4, wherein the peripheral edges of the plate are restrained by the member.

7. The shoe of claim 3, including a forward sole attached to the upper and an arch bridge integral with the heel support and adjacent the downwardly extending wall of the heel support, the arch bridge attached to the upper and extending between the heel support and the forward sole.

8. The shoe of claim 3, wherein the heel support includes an opening exposing a substantial portion of the heel region to the recess.

9. The shoe of claim 3, wherein the rear sole includes an upper midsole portion receivable in the recess and a lower midsole portion slightly larger than the recess to conceal a vertical gap between the wall and the upper midsole portion of the rear sole.

10. The shoe of claim 3, wherein one of the heel support wall and a peripheral surface of the rear sole includes at least one protrusion and the other of the wall and the peripheral surface includes at least one indention for receiving the protrusion, the rear sole detachably secured to the heel support by engaging the protrusion with the indention.

11. The shoe of claim 1, wherein the flexible plate is removable from the shoe.

12. The shoe of claim 1, wherein the plate is substantially planar.

13. The shoe of claim 1, wherein the upper surface of the plate is convex.

14. The shoe of claim 1, including means for detachably securing the rear sole below the heel region.

15. The shoe of claim 14, wherein the rear sole has a bottom surface, at least a portion of which is ground-engaging, the bottom surface including a substantially planar portion and at least one beveled segment nonplanar with the planar portion, the at least one beveled segment inclined upwardly in a direction from an interior portion of the bottom surface toward an outer edge of the bottom surface and having an edge coincident with the outer edge.

16. The shoe of claim 15, wherein the rear sole includes a plurality of beveled segments separated from each other by the substantially planar portion of the bottom surface.

17. The shoe of claim 1, wherein the plate is convex in shape.

18. The shoe of claim 1, wherein the lower surface of the plate is concave.

19. A shoe comprising:

an upper;

a forward sole attached to the upper;

a heel support attached to a heel region of the upper and having at least one wall extending downwardly from the upper, the wall having one of a protrusion and an indention;

a rear sole; and a member innerconnecting the rear sole with the heel support, the member including a first one of an indention and protrusion for engaging the other one of the indention and protrusion on the heel support wall to detachably secure the member and the rear sole to the heel support, the member including a second one of a protrusion and indention for connecting the member to the rear sole and allowing selective rotation of the rear sole relative to the member without disengaging the member from the rear sole or the member from the heel support.

20. The shoe of claim 19, wherein the second one of a protrusion and indention of the member includes a planar rim engaging a groove in the rear sole to allow rotation of the rear sole relative to the member when the shoe is not in use.

21. The shoe of claim 20, wherein the rim includes an anchor for engaging the rear sole to prevent rotation of the rear sole relative to the heel support during use.

22. The shoe of claim 19, wherein the rear sole includes at least one ground-engaging layer and a midsole attached to the ground-engaging layer, the midsole made of an elastomeric material that is more resilient than the ground-engaging layer.

23. The shoe of claim 19, wherein the member is a band having an interior surface with an inwardly facing planar rim for engaging a groove in a peripheral surface of the rear sole, and a threaded exterior surface for engaging a complementary threaded portion of the heel support wall.

24. The shoe of claim 19, wherein the rear sole has a bottom surface, at least a portion of which is ground-engaging, the bottom surface including a substantially planar portion and at least one beveled segment nonplanar with the planar portion, the at least one beveled segment inclined upwardly in a direction from an interior portion of the bottom surface toward an outer edge of the bottom surface and having an edge coincident with the outer edge.

25. A shoe comprising:

an upper having a heel region;

a rear sole secured below the heel region of the upper; and a flexible plate having upper and lower surfaces and supported between at least a portion of the rear sole and at least a portion of the heel region of the upper, peripheral edges of the plate being restrained from movement relative to an interior portion of the plate in a direction substantially perpendicular to a major axis of the shoe so that the interior portion of the plate is deflectable relative to the peripheral edges in a direction substantially perpendicular to the major axis of the shoe.

26. The shoe of claim 25, wherein the flexible plate is supported at its periphery.

27. The shoe of claim 25, including a heel support having at least one wall extending downwardly from the upper to at least partially define a recess, the rear sole secured in the recess of the heel support.

28. The shoe of claim 27, further including a member interconnecting the rear sole with the heel support.

29. The shoe of claim 28, wherein the member includes one of an indention and protrusion for engaging the other one of a protrusion and indention on the heel support wall to attach the member and rear sole to the heel support.

30. The shoe of claim 28, wherein the peripheral edges of the plate are restrained by the member.

31. The shoe of claim 27, including a forward sole attached to the upper and an arch bridge integral with the heel support and adjacent the downwardly extending wall of the heel support, the arch bridge attached to the upper and extending between the heel support and the forward sole.

32. The shoe of claim 27, wherein the heel support includes an opening exposing a substantial portion of the heel region to the recess.

33. The shoe of claim 27, wherein one of the heel support wall and a peripheral surface of the rear sole includes at least one protrusion and the other of the wall and the peripheral surface includes at least one indention for receiving the protrusion, the rear sole detachably secured to the heel support by engaging the protrusion with the indention.

34. The shoe of claim 27, wherein the rear sole includes an upper midsole portion receivable in the recess and a lower midsole portion slightly larger than the recess.

35. The shoe of claim 25, wherein the flexible plate is removable from the shoe.

36. The shoe of claim 25, wherein the plate is substantially planar.

37. The shoe of claim 25, wherein the upper surface of the plate is convex.

38. The shoe of claim 25, wherein the plate is convex in shape.

39. The shoe of claim 25, wherein the lower surface of the plate is concave.

40. The shoe of claim 25, including means for detachably securing the rear sole below the heel region.

41. The shoe of claim 40, wherein the rear sole has a bottom surface, at least a portion of which is ground-engaging, the bottom surface including a substantially planar portion and at least one beveled segment nonplanar with the planar portion, the at least one beveled segment inclined upwardly in a direction from an interior portion of the bottom surface toward an outer edge of the bottom surface and having an edge coincident with the outer edge.

42. The shoe of claim 41, wherein the rear sole includes a plurality of beveled segments separated from each other by the substantially planar portion of the bottom surface.

* * * * *